US007540580B2

(12) United States Patent
Oku

(10) Patent No.: US 7,540,580 B2
(45) Date of Patent: Jun. 2, 2009

(54) LIQUID EJECTION HEAD AND EJECTION ABNORMALITY DETERMINATION METHOD

(75) Inventor: Seiichiro Oku, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 430 days.

(21) Appl. No.: 11/174,513

(22) Filed: Jul. 6, 2005

(65) Prior Publication Data

US 2006/0007260 A1 Jan. 12, 2006

(30) Foreign Application Priority Data

Jul. 7, 2004 (JP) ..... 2004-200451

(51) Int. Cl.
*B41J 29/393* (2006.01)

(52) U.S. Cl. ..... 347/19; 347/14

(58) Field of Classification Search ..... 347/19
See application file for complete search history.

(56) References Cited

U.S. PATENT DOCUMENTS

| | | | | |
|---|---|---|---|---|
| 5,734,391 | A * | 3/1998 | Tanaka et al. | 347/14 |
| 6,257,694 | B1 | 7/2001 | Tokumaru et al. | |
| 6,431,674 | B2 * | 8/2002 | Suzuki et al. | 347/10 |
| 7,104,636 | B2 * | 9/2006 | Davis et al. | 347/85 |
| 2005/0195248 | A1 * | 9/2005 | Nagashima | 347/68 |
| 2005/0219286 | A1 * | 10/2005 | Nagashima | 347/9 |

FOREIGN PATENT DOCUMENTS

| | | | |
|---|---|---|---|
| JP | 60-262655 | A | 12/1985 |
| JP | 11-309874 | A | 11/1999 |
| JP | 11-334102 | A | 12/1999 |
| JP | 2000-318183 | A | 11/2000 |
| JP | 2000-355100 | A | 12/2000 |

* cited by examiner

*Primary Examiner*—Luu Matthew
*Assistant Examiner*—Brian J Goldberg
(74) *Attorney, Agent, or Firm*—Birch, Stewart, Kolasch & Birch LLP

(57) ABSTRACT

The liquid ejection apparatus comprises: an ejection head which has an ejection element, the ejection element including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber; a drive signal application device which applies to the pressurizing device a meniscus vibration drive signal for suppressing increase in viscosity of the liquid in vicinity of the ejection aperture by causing a meniscus surface of the liquid to vibrate and to eject no droplet from the ejection aperture; a pressure determination device which determines pressure in the pressure chamber when the meniscus surface is vibrated by the meniscus vibration drive signal; and a judgment device which judges an abnormal state of the ejection element from pressure information of the pressure chamber based on pressure determination information obtained by the pressure determination device.

16 Claims, 15 Drawing Sheets

LIQUID EJECTION HEAD AND EJECTION ABNORMALITY DETERMINATION METHOD

BACKGROUND OF THE INVENTION

1. Field of the Invention

The present invention relates to a liquid ejection head and an ejection abnormality determination method, more particularly to ejection abnormality determination technology which determines abnormalities in a plurality of ejection apertures which do not perform ejection during an ejection operation in an ejection head having the plurality of ejection apertures.

2. Description of the Related Art

In recent years, inkjet recording apparatuses have come to be used widely as data output apparatuses for outputting images, documents, or the like. By driving recording elements, such as nozzles, provided in a recording head in accordance with data, an inkjet recording apparatus is able to form data onto a print medium (recording medium), such as recording paper, by means of ink ejected from the nozzles.

In an inkjet recording apparatus, a desired image is formed on a print medium by causing a print head having a plurality of nozzles and a print medium to move relatively to each other, while causing ink droplets to be ejected from the nozzles.

In an inkjet recording apparatus, when the ink inside the nozzles makes contact with the air, the ink solvent evaporates from the surface of the ink in contact with the air and the viscosity of the ink increases. If ink whose viscosity has increased in this manner is used, nozzle blockages become liable to occur and this may lead to ejection failures or ejection abnormalities.

Furthermore, if air bubbles become mixed into the pressure chambers of the recording head, then there is significant loss of the pressure applied to the ink by the actuators, and this can lead to ejection abnormalities, such as abnormalities in the amount of ink ejected or the direction of ejection, ejection failures, and the like.

If ejection abnormalities occur as described above, then the image quality deteriorates markedly, and therefore, it is possible to maintain the quality of the recorded image by determining ejection abnormalities of this kind promptly, and eliminating the causes of the ejection abnormalities. In ejection abnormality determination according to the related art, a method is proposed in which the characteristics of a piezoelectric element, or the waveform during driving of a piezoelectric element, is measured and the presence of air bubbles in the pressure chamber (ink chamber) or the presence of an ejection abnormality in a nozzle is determined accordingly.

The need for air bubble determination or ejection abnormality determination of this kind becomes more important in the case of a print head having a multiple-nozzle structure.

On the other hand, in a multiple-nozzle structure, and in particular, a line head, which is the ultimate mode of a multiple-nozzle structure, since the number of nozzles is very large, there may be nozzles which do not perform ejection for a relatively long period of time, depending on the print data. Nozzles of this kind are liable to enter a state which leads to ejection abnormalities, and therefore technology has been proposed which churns the ink in the vicinity of the nozzles by applying a vibration to the ink to a degree that not does cause ejection of the ink, thereby preventing increase in the viscosity of the ink.

More specifically, in a method for suppressing increase in the viscosity of the ink in the nozzles by vibrating the meniscus surface of the ink by means of the actuators used for ink ejection, it is possible to apply a low voltage or a high-frequency voltage to the actuators at a level which does not cause ejection of ink from the nozzles, thereby churning the ink in the vicinity of the meniscus surface and slowing the increase in the viscosity of the ink.

Japanese Patent Application Publication No. 60-262655 discloses an ink ejection device, in which electrical distortion elements are provided as means of changing the internal pressure of the ink inside ink chambers of an on-demand type inkjet head, and a drive circuit for driving the head is provided, in addition to a vibration analyzing and determining device which determines the intrinsic vibration of the head caused by the potential difference generated between the electrodes of the electrical distortion element, simultaneously with the driving of the head. A device is provided for expelling air bubbles from inside the ink flow channels when air bubbles are determined to be present in the ink flow channels by this determining device.

Japanese Patent Application Publication No. 2000-318183 discloses a replenishment determination apparatus and replenishment determination method for the recording head of a printer, in which the state of replenishment of the ink in the recording head is determined electrically by obtaining the profile of the resonance point of piezoelectric elements applying an ejection pressure to ink.

Japanese Patent Application Publication No. 2000-355100 discloses a printer apparatus, in which nozzle determination method and print method described in, piezoelectric elements provided respectively at nozzles are driven by applying a measurement input signal to the piezoelectric elements, a phase output waveform representing the phase divergence between the measurement input voltage and the measurement output voltage after driving the piezoelectric elements is generated, together with a peak output waveform representing the amplitude of the measurement output waveform, and the nozzles are inspected by comparing these waveforms with the frequency characteristics of a previously prepared phase output waveform and peak output waveform.

Japanese Patent Application Publication No. 11-334102 discloses air bubble determination circuit and air bubble determination method in an inkjet printer, in which the impedance of the piezoelectric elements of the head is measured at an arbitrary frequency, the frequency characteristics of the impedance are compiled, and it is determined whether or not air bubbles are attached to the piezoelectric elements on the basis of these frequency characteristics.

Japanese Patent Application Publication No. 11-309874 discloses an inspection method for a liquid ejection apparatus, in which an excitation element and a reflection plate are disposed facing each other on either side of the line linking a vibrating body and a nozzle plate, and when the excitation element applies a vibration directly to the ink inside the ink chamber, then this vibration is reflected by the reflection plate and returned again to the excitation element, this returning vibration being acquired as a determination signal and being analyzed by means of an excitation/determination device.

However, in the ejection abnormality determination according to the related art, a plurality of determination operations are required in order to judge the respective nozzles, and in the case of a head having a large number of nozzles, in particular, the time required for the whole determination operation becomes large, and this ultimately reduces the high print capacity (productivity) originally achieved by adopting a large number of nozzles in the head.

Furthermore, in the ejection abnormality determination according to the related art, in a method which determines abnormalities by actually ejecting ink or a method which determines abnormalities without actually ejecting ink, ultimately, ink is ejected and the determination operation cannot be performed during printing.

In the ink ejection apparatus described in Japanese Patent Application Publication No. 60-262655, it is difficult to set the threshold value for judging ejection abnormalities, since the potential difference generated between the electrodes of the electrical distortion elements is a very low voltage. Furthermore, since analogue values are measured and analyzed, the S/N ratio is low and therefore it is essential that judgment is made on the basis of a plurality of measurements (determination operations) and statistical processing, or the like.

Furthermore, in the replenishment determination apparatus and replenishment determination method for the recording head of a printer as described in Japanese Patent Application Publication No. 2000-318183, the printer apparatus, nozzle determination method and print method described in Japanese Patent Application Publication No. 2000-355100, the inkjet printer, air bubble determination circuit and air bubble determination method described in Japanese Patent Application Publication No. 11-334102, and the determination method for a liquid ejection apparatus described in Japanese Patent Application Publication No. 11-309874, it is necessary perform determination over a broad frequency range, from a low-frequency region to a high-frequency region. Furthermore, the analogue signal handled in this case has a low S/N ratio and therefore it is essential that judgment is made on the basis of a plurality of measurements (determination operations) and statistical processing, or the like.

SUMMARY OF THE INVENTION

The present invention has been contrived in view of the foregoing circumstances, an object thereof being to provide a liquid ejection apparatus and an ejection abnormality determination method whereby high productivity is ensured by determining ejection abnormalities in ejection apertures which do not perform ejection during the execution of ejection, as well as ensuring desirable print quality reliably by determining ejection abnormalities.

In order to attain the aforementioned object, the present invention is directed to a liquid ejection apparatus, comprising: an ejection head which has an ejection element, the ejection element including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber; a drive signal application device which applies to the pressurizing device a meniscus vibration drive signal for suppressing increase in viscosity of the liquid in vicinity of the ejection aperture by causing a meniscus surface of the liquid to vibrate and to eject no droplet from the ejection aperture; a pressure determination device which determines pressure in the pressure chamber when the meniscus surface is vibrated by the meniscus vibration drive signal; and a judgment device which judges an abnormal state of the ejection element from pressure information of the pressure chamber based on pressure determination information obtained by the pressure determination device.

According to the present invention, since the pressure of a pressure chamber is determined by the pressure determination device, while vibrating the meniscus by means of a meniscus vibration drive signal which does not cause a liquid droplet to be ejected from the ejection aperture, an abnormality in an ejection element being judged on the basis of the pressure determination results, then it is possible to restrict oscillation of the meniscus effectively, while maintaining the function of preventing increase in the viscosity of the liquid in the vicinity of the meniscus, and since it is possible to improve the sensitivity of waveform determination in the event of an abnormality in the ejection element, then even minute air bubbles, and the like, can be determined.

In other words, abnormalities in ejection elements can be detected without ejecting liquid droplets from the ejection apertures.

The ejection head may be a full line type ejection head in which ejection apertures for ejecting liquid droplets are arranged through a length corresponding to the entire width of the receivable region of the ejection receiving medium, or a serial type ejection head (shuttle scanning type ejection head) in which a short head having ejection apertures for ejecting liquid droplets arranged through a length that is shorter than the entire width of the receivable region of the ejection receiving medium ejects liquid droplets onto the ejection receiving medium while scanning in the breadthways direction of the ejection receiving medium.

A full line ejection head may be formed to a length corresponding to the full width of the receivable region of the ejection receiving medium by combining short head having rows of ejection apertures which do not reach a length corresponding to the full width of the receivable region of the ejection receiving medium, these short heads being joined together in a staggered matrix fashion.

As the pressurizing device, it is possible to use a piezoelectric body (piezoelectric actuator) such as a PZT piezoelectric element or to use a heater which generates bubbles by heating the ink inside the pressure chamber.

The mode of vibrating the meniscus may involve vibrating the meniscus within a range whereby the meniscus does not exit to the exterior the ejection aperture, or it may involve vibrating the meniscus within a range which includes the exterior of the ejection aperture, in such a manner that no liquid is separated from the meniscus in the form of a droplet.

The ejection apertures may include nozzles which eject liquid droplets onto the ejection receiving medium, and the nozzles may include, in addition to the opening sections, the fine tube sections which connect to the opening sections.

An abnormality in an ejection element may involve the occurrence of air bubbles in the pressure chamber (mixing of air bubbles), increase in the viscosity of the liquid in the vicinity of the ejection apertures, a fault in the pressurizing device, and the like. If an abnormality of this kind occurs in an ejection element, then an ejection abnormality may occur in the liquid droplet ejected from the ejection aperture (for instance, an ejection failure may occur). Therefore, by determining an abnormality in an ejection element, it is possible to judge the presence or absence of an ejection abnormality in the ejection element.

Preferably, the meniscus vibration drive signal comprises at least two continuous signals which drive the pressurizing device in such a manner that the meniscus surface is drawn in, in a direction opposite to a liquid ejection direction.

According to the present invention, since the meniscus vibration drive signal is composed so as to include a plurality of continuous signals which drive the meniscus in the draw-in direction, then continuous meniscus draw-in operations are performed, and oscillation of the meniscus can be restricted (suppressed) in such a manner that ejection of a liquid droplet from the ejection aperture is reliably prevented.

Furthermore, since no liquid droplet is ejected from the ejection aperture, even if the amplitude (voltage) of the meniscus vibration drive signal is large, then it is possible to increase the accuracy and sensitivity of pressure determination, and hence the presence of minute air bubbles can be detected.

Preferably, the at least two continuous signals have a voltage waveform same with each other. According to this, since the signals forming the meniscus vibration drive signal have the same voltage waveform, then the voltage waveform of the meniscus vibration drive signal is a simple waveform.

Preferably, the meniscus vibration drive signal comprises: a first signal which drives the pressurizing device in such a manner that the meniscus surface is drawn in, in the direction opposite to the liquid ejection direction; and a second signal which is continuous to the first signal and drives the pressurizing device in such a manner that the meniscus surface is drawn in, in the direction opposite to the liquid ejection direction, wherein taking a resonance cycle of liquid ejection to be T, a time difference between a start point of the first signal and a start point of the second signal is T/2.

According to the present invention, by setting the cycle of the meniscus vibration drive signal to be ½ of the ejection cycle, it is possible to suppress oscillation of the meniscus even more effectively.

The first signal contributes principally to performing a meniscus draw-in operation, and the second signal contributes principally to an operation of suppressing the movement of the meniscus in the ejection direction (restricting operation). The first signal and the second signal, which are two continuous signals, may have the same amplitude or they may have different amplitudes.

Preferably, the pressurizing device also serves as the pressure determination device. More specifically, if the same device serves as the pressure determination device and the pressurizing device, then this contributes to saving space and reducing cost. Furthermore, by dividing the timing at which a drive voltage is applied and the timing at which the pressure is determined, common wiring can be used for the pressure determination device and the pressurizing device, and it is possible to obtain a pressure determination signal (pressure waveform) for determining the pressure in the pressure chamber after applying the drive signal.

Preferably, the pressure determination device comprises a mechanical-electrical transducer which generates a signal in accordance with displacement thereof, and determines the pressure of the pressure chamber by measuring at least one of impedance, voltage and current of the mechanical-electrical transducer. According to this, since the pressure determination device is composed so as to include a mechanical-electrical transducer, and the pressure is determined by measuring at least one of the impedance, voltage and current of the determination signal outputted from the mechanical-electrical transducer, then the pressure can be determined readily.

The mechanical-electrical transducer may include an electrical distortion element which generates a voltage in accordance with the pressure received by the mechanical-electrical transducer, such as a PZT piezoelectric element or other piezoelectric body, or a strain gauge. Furthermore, the mechanical-electrical transducer may also function as an electrical-mechanical transducer which generates a distortion in accordance with the voltage applied thereto.

Alternatively, it is also preferable that the pressure determination device comprises a mechanical-electrical transducer which is provided separately from the pressurizing device and generates a signal in accordance with pressure applied to the mechanical-electrical transducer; and the pressure determination device determines the pressure of the pressure chamber through the mechanical-electrical transducer. According to this, by providing a pressure determination device separately from the pressurizing device and also including in the pressure determination device a mechanical-electrical transducer which generates a signal corresponding to the distortion thereof, it is possible to use a mechanical-electrical transducer having a mechanical-electrical conversion rate that is suitable for pressure determination, in the pressure determination device, while using an electrical-mechanical transducer having an electrical-mechanical conversion rate that is suitable for pressurizing, in the pressurizing device.

The pressure determination device used may be the same type of device as the pressurizing device, or it may be a different device which has good pressure determination characteristics.

Preferably, the liquid ejection apparatus further comprises a sampling cycle selection device which selects a sampling cycle at which the pressure of the pressure chamber is determined by the pressure determination device.

If the pressure determination in the pressure chambers is carried out intermittently at a prescribed timing, then it is possible to reduce the burden on the control system. On the other hand, if the pressure of the pressure chambers is determined at all times while causing the meniscus to vibrate, then it is possible to recognize any change in the pressure of a pressure chamber, in real time.

It is also possible to prepare a determination control signal (determination clock) in advance, and to perform pressure determination independently. It is preferable that the pressure in the pressure chambers is determined at least one during meniscus vibration.

It is preferable that the meniscus vibration drive signal is applied at all times to the ejection elements which are not performing an ejection operation, in such a manner that meniscus therein is caused to vibrate.

In order to attain the aforementioned object, the present invention is also directed to a liquid ejection apparatus, comprising: an ejection head which has a plurality of ejection elements, each of the plurality of ejection elements including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber; a drive signal application device which applies, to the pressurizing device of at least one of the plurality of ejection elements having an idle ejection aperture performing no ejection during an ejection operation, a meniscus vibration drive signal for suppressing increase in viscosity of the liquid in vicinity of the idle ejection aperture by causing a meniscus surface of the liquid to vibrate and to eject no droplet from the idle ejection aperture; a pressure determination device which determines pressure in the pressure chamber of the at least one of the plurality of ejection elements when the meniscus surface is vibrated by the meniscus vibration drive signal; and a judgment device which judges an abnormal state of the at least one of the plurality of ejection elements from pressure information of the pressure chamber based on pressure determination information obtained by the pressure determination device.

According to the present invention, since the idle ejection apertures, which do not perform ejection during an ejection operation, have a high probability of producing an ejection abnormality, ejection abnormalities are prevented by causing the meniscus to vibrate by applying a meniscus vibration drive signal to the idle ejection apertures, while at the same time, ejection abnormalities can be discovered at an early stage on the basis of abnormalities in the ejection elements, and maintenance can be carried out swiftly in order to resolve such ejection abnormalities.

In order to attain the aforementioned object, the present invention is also directed to an ejection abnormality determination method for a liquid ejection apparatus comprising an ejection head which has an ejection element, the ejection element including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber, the method comprising the steps of: applying to the pressurizing device a meniscus vibration drive signal for suppressing increase in viscosity of the liquid in vicinity of the ejection aperture by causing a meniscus surface of the liquid to vibrate and to eject no droplet from the ejection aperture; determining a pressure abnormality in the pressure chamber; and judging an ejection abnormality in the ejection aperture provided at the pressure chamber from a result obtained in the pressure abnormality determining step.

According to the present invention, increase in the viscosity of the liquid in the vicinity of the meniscus is suppressed by applying a meniscus vibration drive signal which causes the meniscus to vibrate in such a manner that no liquid droplets are ejected from the ejection apertures, while the pressure of the pressure chambers during application of the meniscus vibration drive signal is determined, an abnormality in an ejection element having a particular pressure chamber is determined from the pressure in that pressure chamber, and an ejection abnormality is judged on the basis of an abnormality in an ejection element, and therefore, the vibration for the purpose of preventing increase in the viscosity of the meniscus is effectively suppressed, while maintaining the effect of preventing increase in viscosity at the meniscus, and any ejection abnormality that may occur can be determined in a highly efficient manner.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
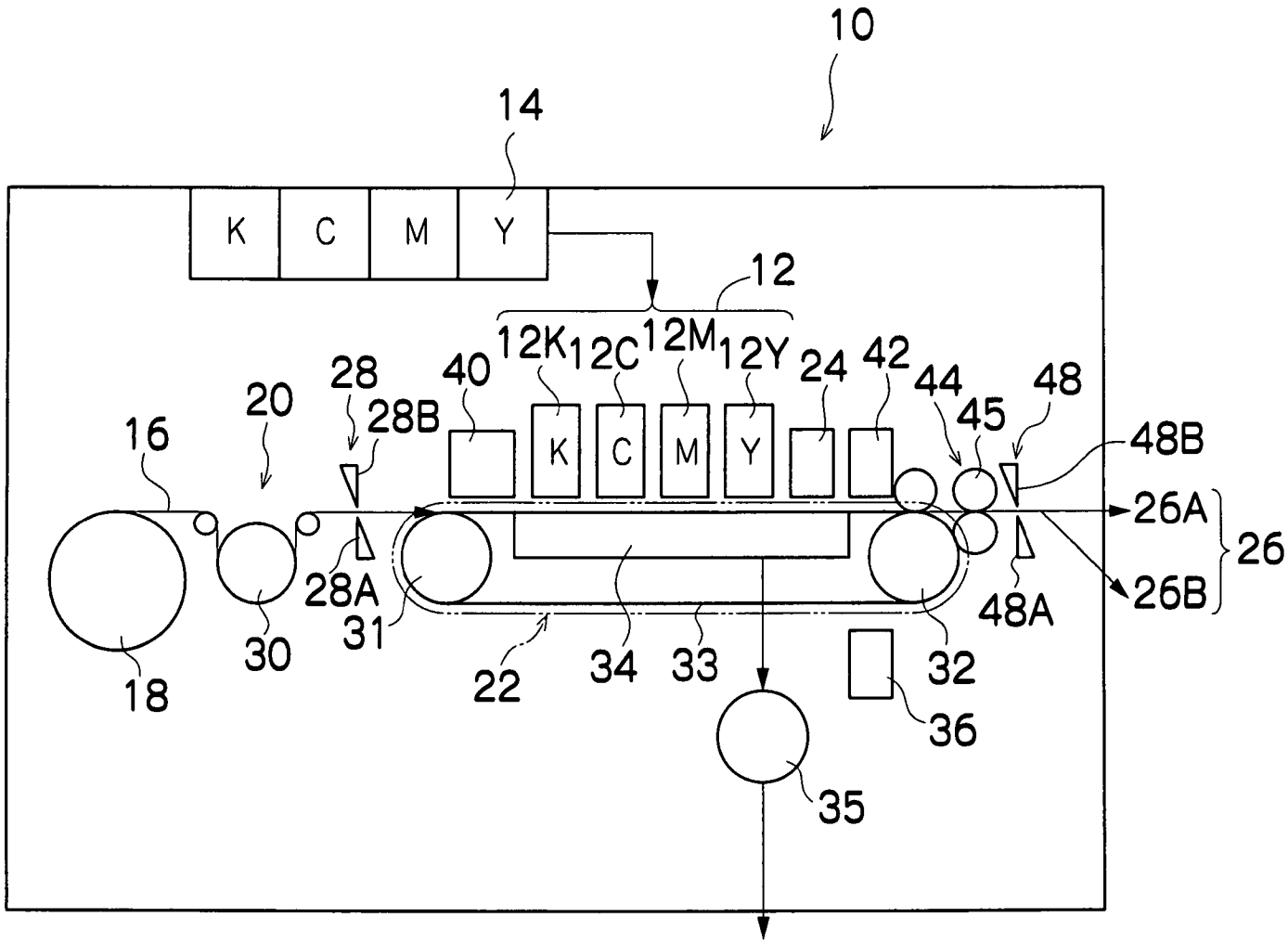
FIG. 1 is a basic compositional diagram of an inkjet recording apparatus installed with a print head according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16 (corresponding to the recording medium); a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; and a paper output unit 26 for outputting printed recording paper (printed matter) to the exterior.

In FIG. 1, a magazine for rolled paper (continuous paper) is shown as an example of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the recording paper 20 has a curl in which the surface on which the print is to be made is slightly rounded in the outward direction.

In the case of the configuration in which roll paper is used, a cutter (a first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

After decurling in the decurling unit 24, the cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 forms a horizontal plane (flat plane).

The belt 33 has a width that is greater than the width of the recording paper 16, and a plurality of suction restrictors (not shown) are formed on the belt surface. A suction chamber 34 is disposed in a position facing the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism, but since the print region passes through the roller nip, the printed surface of the paper makes contact with the rollers immediately after printing, and hence smearing of the image is liable to occur. Therefore, a suction belt conveyance mechanism in which nothing comes into contact with the image surface in the printing area is preferable.

A heating fan 40 is provided on the upstream side of the print unit 12 in the paper conveyance path formed by the suction belt conveyance unit 22. This heating fan 40 blows heated air onto the recording paper 16 before printing, and thereby heats up the recording paper 16. Heating the recording paper 16 before printing means that the ink will dry more readily after landing on the paper.

Figure 2:
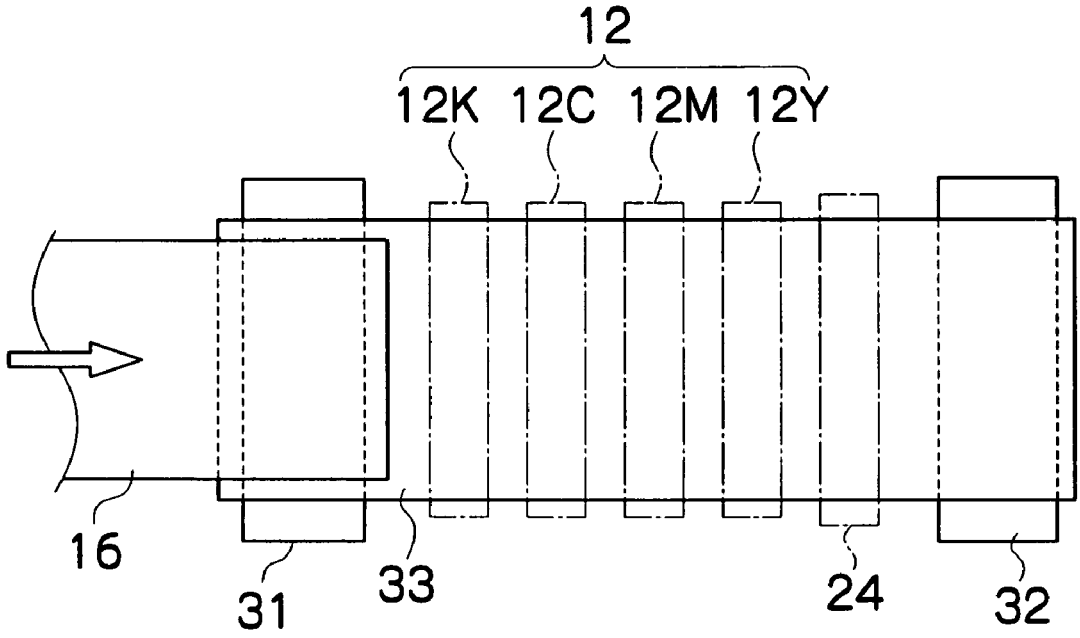
FIG. 2 is a plan view of the principal part of the peripheral printing region of the inkjet recording apparatus illustrated in FIG. 1.

The print unit 12 is a so-called "full line head" in which a line head having a length corresponding to the maximum paper width is arranged in a direction (main scanning direction) that is perpendicular to the conveyance direction of the recording paper (sub-scanning direction) (see FIG. 2). An example of the detailed structure is described below (in FIG. 3A to FIG. 5), but each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the recording paper conveyance direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width (the entire width of the printable region) of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, via a tube channel (not illustrated). The ink storing and loading unit 14 also comprises a warning device (for example, a display device or an alarm sound generator) for warning when the remaining amount of any ink is low, and has a mechanism for preventing loading errors among the colors.

A post-drying unit 42 is disposed following the printing unit 12. The post-drying unit 42 is a device to dry the printed image surface, and includes a heating fan, for example.

It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Next, the structure of a print head will be described. The print heads 12K, 12C, 12M and 12Y provided for the respective ink colors have the same structure, and a reference numeral 50 is hereinafter designated to any of the print heads 12K, 12C, 12M and 12Y.

Figure 3A:
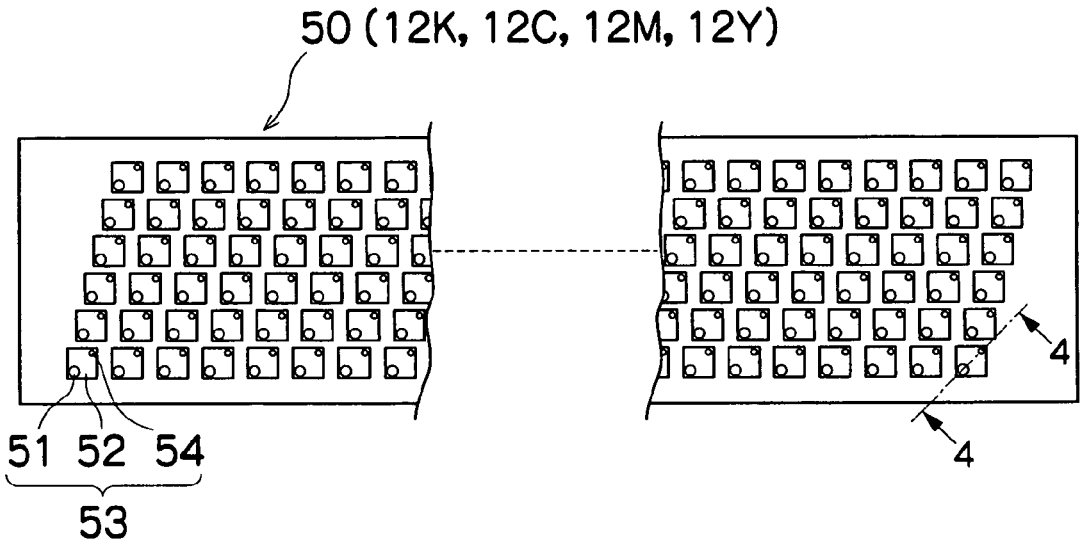
FIGS. 3A to 3C are plan view perspective diagrams showing an example of the composition of a print head.
Figure 3B:
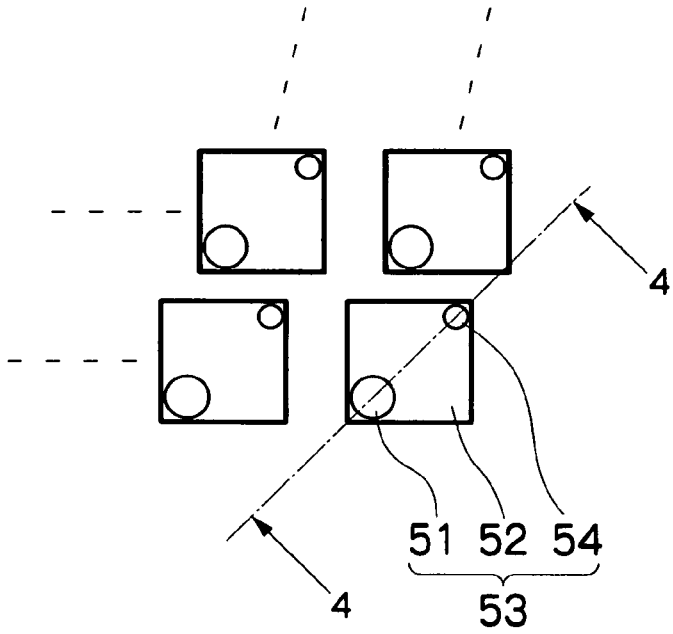
Figure 3C:
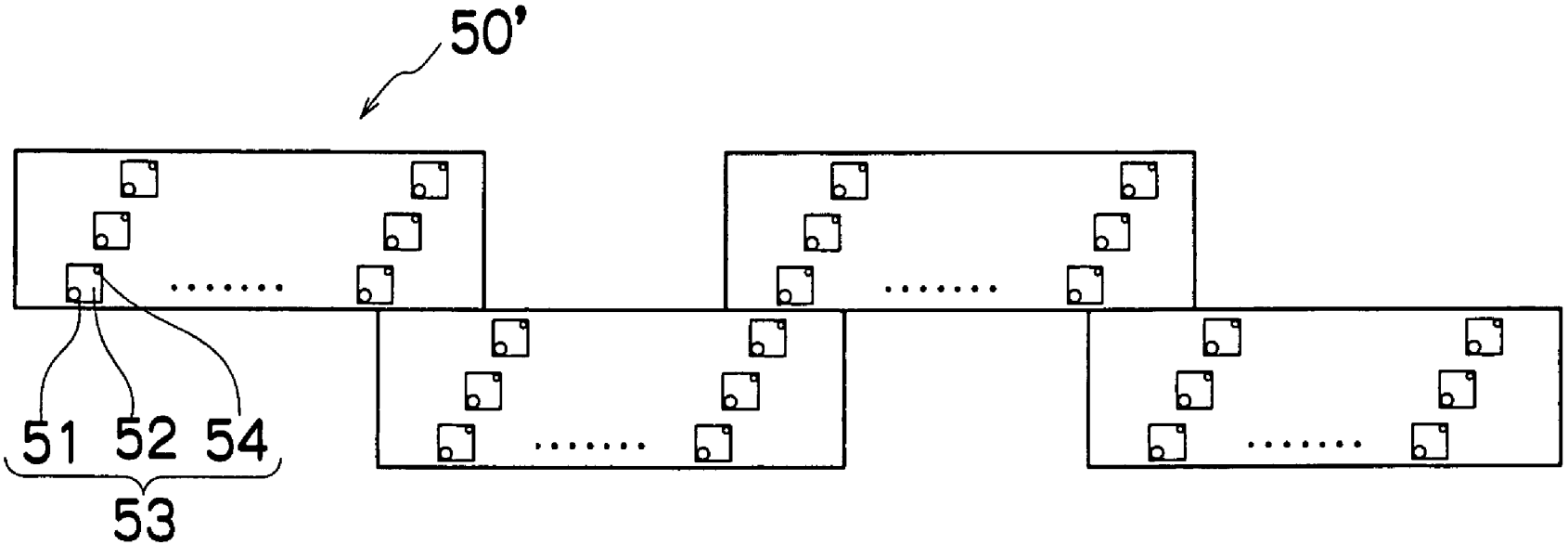
Figure 4:
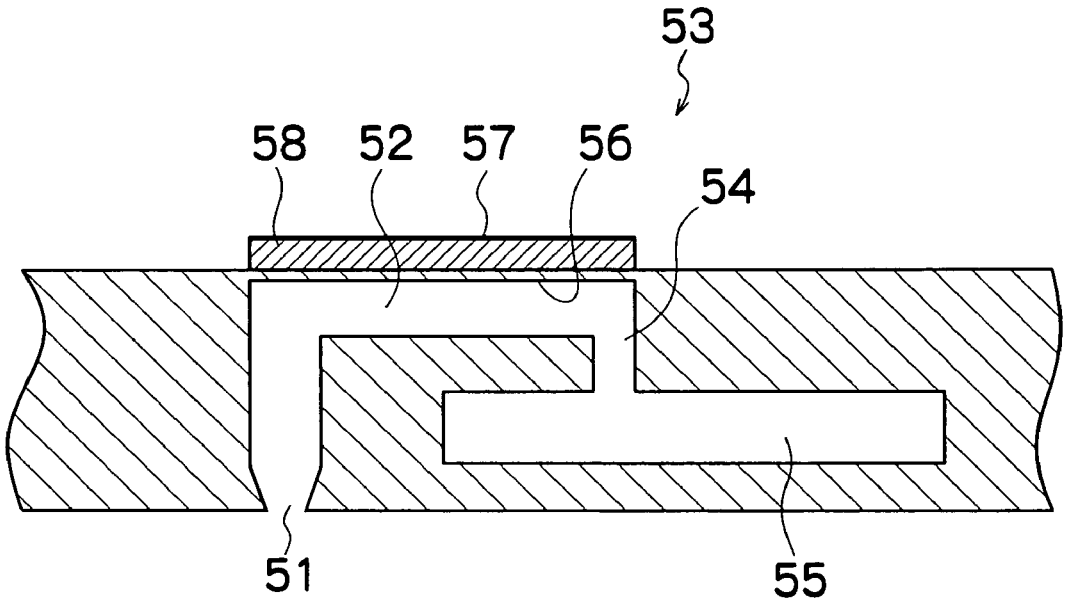
FIG. 4 is a cross-sectional view along line 4-4 in FIGS. 3A and 3B.

FIG. 3A is a plan view perspective diagram showing an example of the structure of a print head 50, and FIG. 3B is an enlarged diagram of a portion of same. Furthermore, FIG. 3C is a plan view perspective diagram showing a further example of the composition of a print head 50, and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording medium, it is necessary to achieve a high density of the nozzle pitch in the print head 50. As shown in FIGS. 3A to 3C and FIG. 4, the print head 50 in the present embodiment has a structure in which a plurality of ink chamber units 53 (ejection elements), each comprising nozzles 51 for ejecting ink droplets and pressure chambers 52 corresponding to the nozzles 51, are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the recording medium.

Moreover, as shown in FIG. 3C, it is also possible to use respective heads 50' of nozzles arranged to a short length in a two-dimensional fashion, and to combine same in a zigzag arrangement, whereby a length corresponding to the full width of the print medium is achieved.

The pressure chamber 52 provided corresponding to each of the nozzles 51 is approximately square-shaped in plan view, and the nozzles 51 and a supply port 54 are provided respectively at either corner of a diagonal of the pressure chamber 52. Each pressure chamber 52 is connected via the supply port 54 to the common flow passage 55.

An actuator 58 provided with an individual electrode 57 is joined to a pressure plate 56 which forms the upper face of the pressure chamber 52, and the actuator 58 is deformed when a drive voltage is supplied to the individual electrode 57, thereby causing ink to be ejected from the nozzle 51. When ink is ejected, new ink is supplied to the pressure chamber 52 from the common flow passage 55, via the supply port 54.

Furthermore, the actuator 58 may be used as a pressure determination sensor (pressure determination device) which determines pressure change inside the pressure chamber 52. A detailed description is given hereinafter, but an electrical distortion element, such as a PZT piezoelectric element (a mechanical-electrical transducer), is used for the actuator 58, and if a drive signal is applied to the individual electrode 57, then the pressure plate 56 deforms in response to distortion generated in the actuator 58 and the ink inside the pressure chamber 52 is ejected.

On the other hand, if a distortion (displacement) is generated in the actuator 58 (pressure plate 56) due to pressure change in the pressure chamber 52, then the actuator 58 generates a voltage (potential difference) corresponding to this displacement. If this potential difference is read in from the individual electrode 57 and used as a pressure determination signal (pressure determination information), taking the common electrode 55 as a reference potential, then the actuator 58 functions as a pressure determination sensor for the pressure chamber 52.

Figure 5:
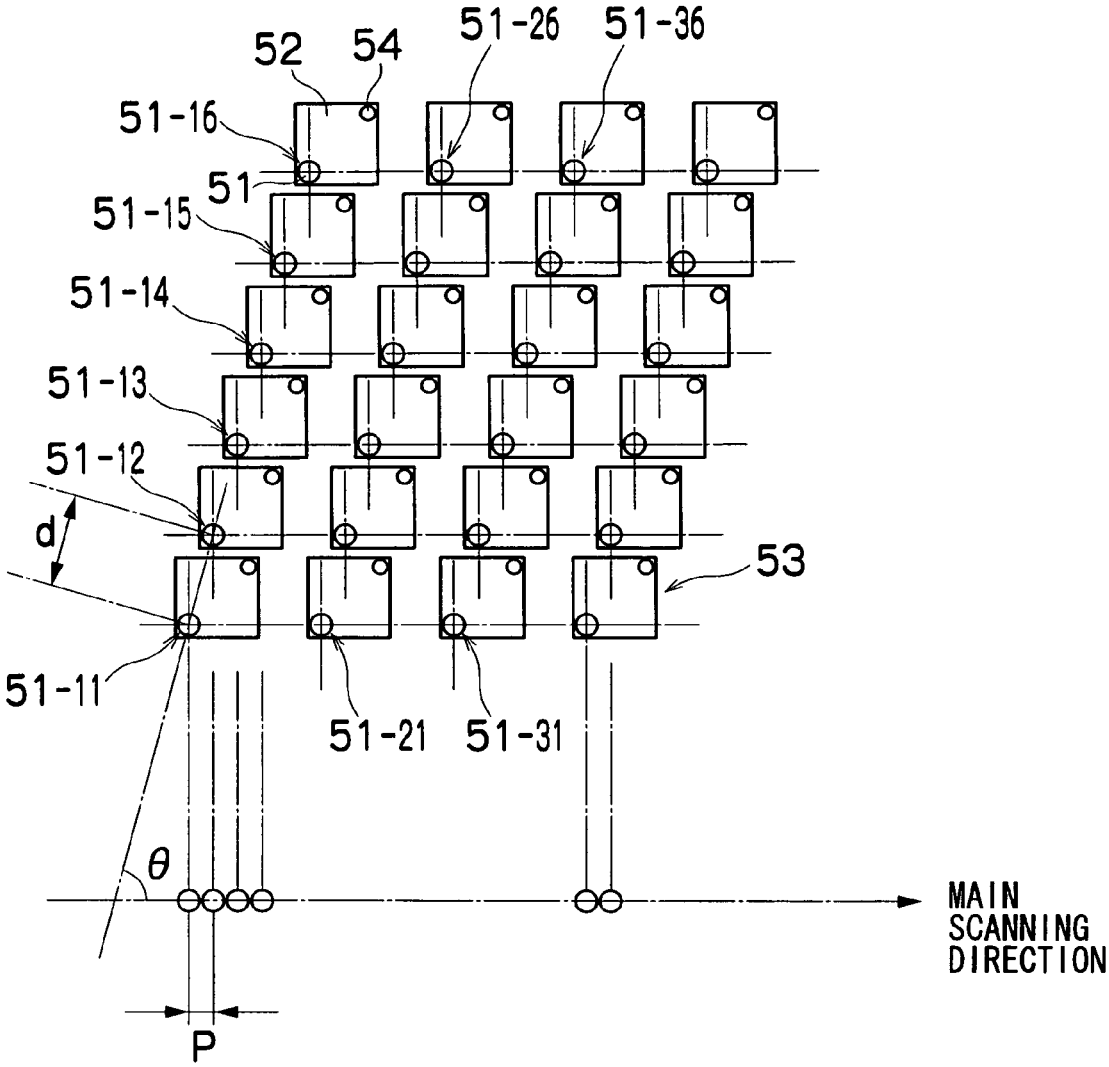
FIG. 5 is an enlarged view showing a nozzle arrangement in the print head illustrated in FIG. 3A.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction will be $d \times \cos\theta$.

More specifically, the arrangement can be treated equivalently to one wherein the respective nozzles 51 are arranged in a linear fashion at uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the image recordable width, the "main scanning" is defined as printing a line formed of a row of dots, or a line formed of a plurality of rows of dots in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of a line formed of a row of dots, or a line formed of a plurality of rows of dots, formed by the main scanning, while moving the full-line head and the recording paper relatively to each other.

Figure 6:
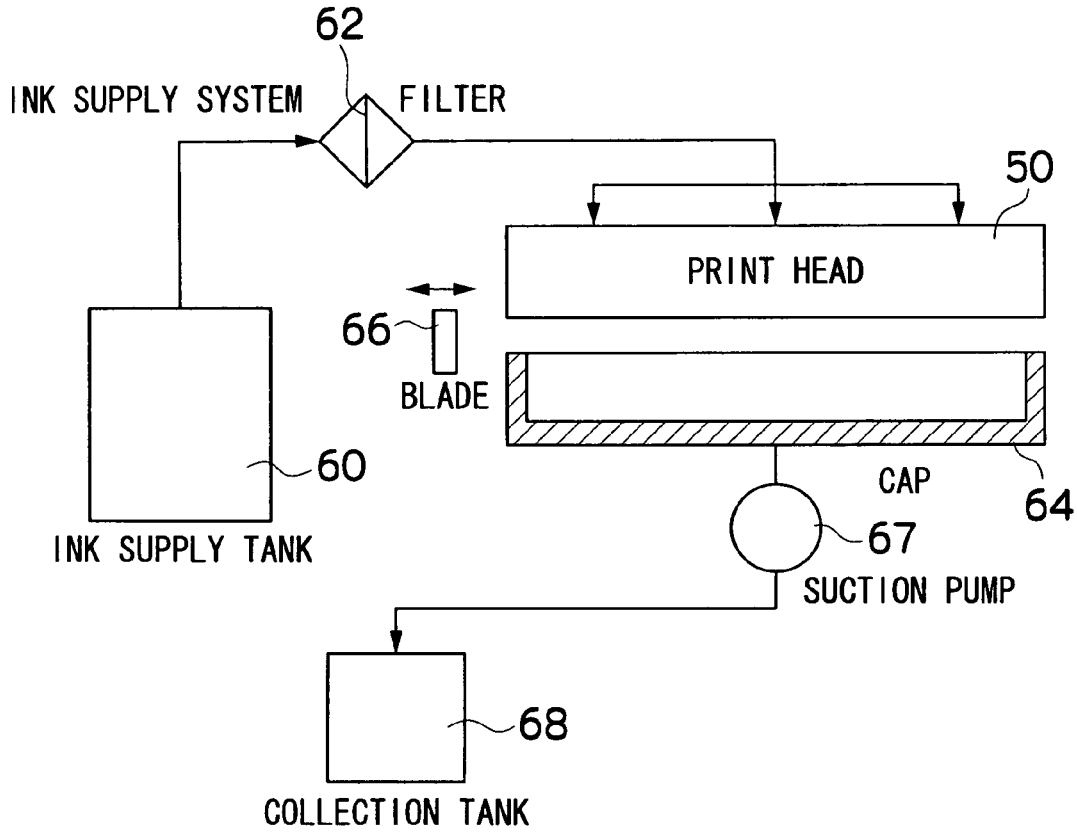
FIG. 6 is an approximate diagram showing the composition of an ink supply system in the inkjet recording apparatus.

When implementing the present invention, the arrangement of the nozzles is not limited to that of the example illustrated. Moreover, in the present embodiment, a method is employed in which an ink droplet is ejected by means of the deformation of the actuator 58, which is typically a piezoelectric element. However, in implementing the present invention, the method used for ejecting ink is not limited in particular, and instead of a piezo jet method, it is also possible to apply various types of methods, such as a thermal jet method where the ink is heated and bubbles are caused to form therein by means of a heat generating body such as a heater, ink droplets being ejected by means of the pressure of these bubbles. FIG. 6 is a general diagram showing the composition of an ink supply system in an inkjet recording apparatus 10, and if a thermal jet system is adopted, then it is necessary to provide a pressure determination device (not illustrated in FIG. 5 and indicated by reference numeral 98 in FIG. 7) which determines the pressure change in the pressure chamber 52.

The ink supply tank 60 is the base tank for supplying ink, and it is disposed in the ink storing and loading unit 14 illustrated in FIG. 1. The ink supply tank 60 may adopt a system for replenishing ink by means of a replenishing opening (not illustrated), or a cartridge system wherein cartridges are exchanged independently for each tank, whenever the residual amount of ink has become low. If the type of ink is changed in accordance with the type of application, then a cartridge based system is suitable. In this case, desirably, type information according to the ink is identified by means of a bar code, or the like, and the ejection of the ink is controlled in accordance with the ink type. The ink supply tank 60 in FIG. 6 is equivalent to the ink storing and loading unit 14 shown in FIG. 1 and described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face is thereby covered with the cap 64.

During printing or standby, if the use frequency of a particular nozzle 51 is low, and if it continues in a state of not ejecting ink for a prescribed time period or more, then the solvent of the ink in the vicinity of the nozzle evaporates and the viscosity of the ink increases. In a situation of this kind, it will become impossible to eject ink from the nozzle 51, even if the actuator 58 is operated.

Therefore, before a situation of this kind develops (namely, while the ink is within a range of viscosity which allows it to be ejected by operation of the actuator 58), the actuator 58 is operated, and a preliminary ejection ("purge", "blank ejection", "liquid ejection" or "dummy ejection") is carried out in the direction of the cap 64 (ink receptacle), in order to expel the degraded ink (namely, the ink in the vicinity of the nozzle which has increased viscosity).

Furthermore, if air bubbles enter into the ink inside the print head 50 (inside the pressure chamber 52), then even if the actuator 58 is operated, it will not be possible to eject ink from the nozzle. In a case of this kind, the cap 64 is placed on the print head 50, the ink (ink containing air bubbles) inside the pressure chamber 52 is removed by suction, by means of a suction pump 67, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out while the increase in the viscosity of the ink is still minor.

The cleaning blade 66 is composed of rubber or another elastic member, and can slide on the ink ejection surface (surface of the nozzle plate) of the print head 50 by means of a blade movement mechanism (wiper, not illustrated). If there are ink droplets or foreign matter adhering to the nozzle plate, then the nozzle plate surface is wiped by causing the cleaning blade 66 to slide over the nozzle plate, thereby cleaning the nozzle plate surface. When the soiling on the ink ejection surface has been cleaned away by means of the blade mechanism, preliminary ejection is carried out in order to prevent mixing of foreign matter inside the nozzles 51, as a result of the blade.

Figure 7:
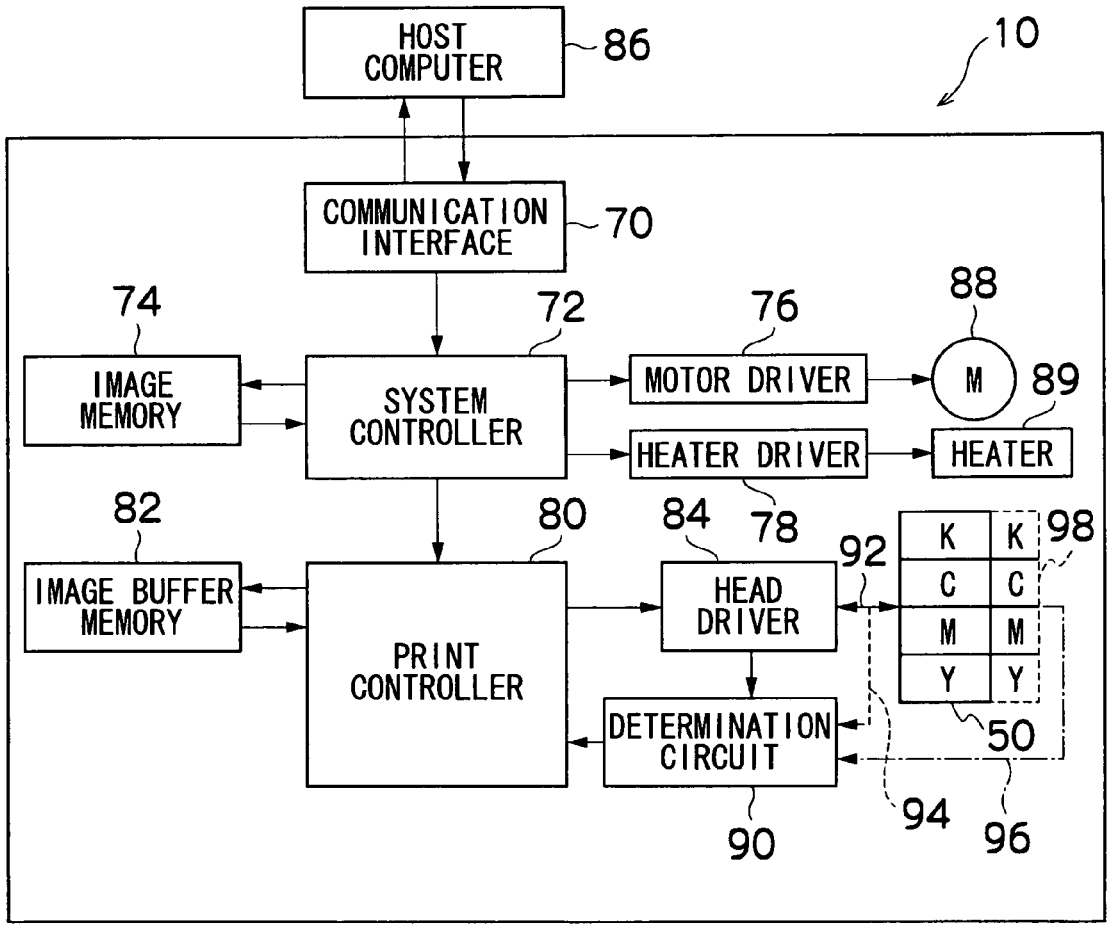
FIG. 7 is a block diagram of the principal components showing the system configuration of the inkjet recording apparatus.

FIG. 7 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the actuators 58 of the print heads of the respective colors 12K, 12C, 12M and 12Y on the basis of print data supplied by the print controller 80. The head driver 84 can be provided with a feedback control system for maintaining constant drive conditions for the print heads.

Furthermore, the head driver 84 causes the meniscus to vibrate without causing ink to be ejected from the nozzle 51, on the basis of a meniscus vibration drive command supplied by the print controller 80.

Various control programs are stored in a program storage section (not illustrated), and a control program is read out and executed in accordance with commands from the system controller 72. The program storage section may use a semiconductor memory, such as a ROM, EEPROM, or a magnetic disk, or the like. An external interface may be provided, and a memory card or PC card may also be used. Naturally, a plurality of these storage media may also be provided.

The program storage section may also serves as a storage device for storing operational parameters, and the like (not illustrated).

Furthermore, the actuator 58 provided at each pressure chamber 52 not only applies an ejection pressure to the ink inside the pressure chamber in accordance with the applied drive signal, but also generates a pressure determination signal (voltage) in accordance with the pressure (pressure change) in the pressure chamber 52.

This pressure determination signal is supplied to the print controller 80 after prescribed signal processing, such as elimination of noise components and amplification, by means of the determination circuit 90, and the print controller 80 obtains pressure information of the pressure chamber 52 and judges an abnormality in the ink chamber unit 53 from this pressure information.

The individual electrode 57 provided in the actuator 58 not only functions as the drive signal application electrode for the actuator 58, but also functions as an output electrode for the pressure determination signal. Consequently, in the signal from the head driver 84 to the actuator 58, it is possible for a drive signal and a pressure determination signal to be transmitted by means of a common wire and for the pressure determination signal to be obtained after applying a drive signal as indicated by reference numeral 92, or it is possible for a drive signal and a pressure determination signal to be transmitted by means of separate wires, and for the pressure determination signal to be obtained from application of the drive signal until after application of the drive signal as indicated by reference numeral 94 (the arrowed broken line in the drawing).

Furthermore, the reference numeral 96 (indicated by the arrowed single-dotted line) shows the flow of the signals between the determination circuit 90 and the pressure determination device 98, in a case where a pressure determination device 98 is provided separately to the actuator 58.

Determining Ejection Abnormalities

Next, ejection abnormality determination in the inkjet recording apparatus 10 will be described.

In the inkjet recording apparatus 10, a function is provided whereby the actuators 58 shown in FIG. 4 of the idle nozzles which do not eject ink during a printing operation are caused to operate by applying a drive signal which does not cause ejection of ink (a meniscus vibration drive signal) to the actuators 58, the pressure of the pressure chambers 52 is determined, and an abnormal state in an ink chamber unit 53 including the nozzle 51, pressure chamber 52 and actuator 58 is determined from this pressure information. Furthermore, at the same time as determining an abnormal state, it is possible to prevent increase in the viscosity of the ink by churning the ink in the vicinity of the nozzle.

An abnormality in an ink chamber unit 53 may be an increase in the viscosity of the ink in the vicinity of the nozzle 51, the occurrence of an air bubble inside the pressure chamber 52 (mixing of air bubble), a fault in the actuator 58, or the like, and if an abnormality such as these occurs, then it is no longer possible to perform satisfactory ejection of the ink.

Firstly, the drive signal applied to the actuator 58 will be described. The application of a drive signal to an actuator 58 provided at a pressure chamber 52 having a nozzle 51 may also be referred to simply as "applying a drive signal to the nozzle".

Figure 8A:
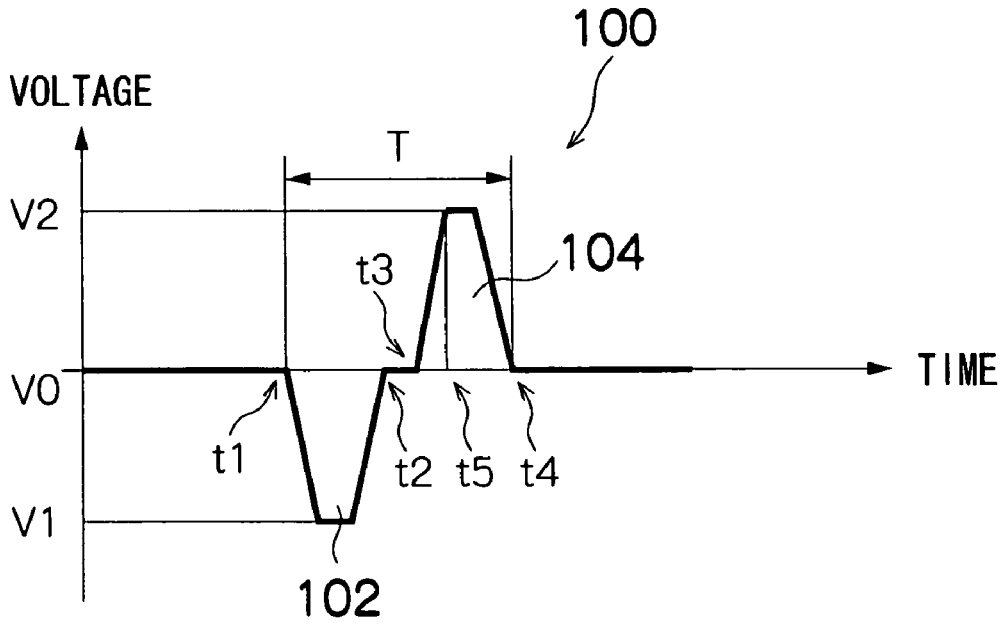
FIGS. 8A and 8B are diagram illustrating an ejection drive signal and a pressure waveform during ejection.
Figure 8B:
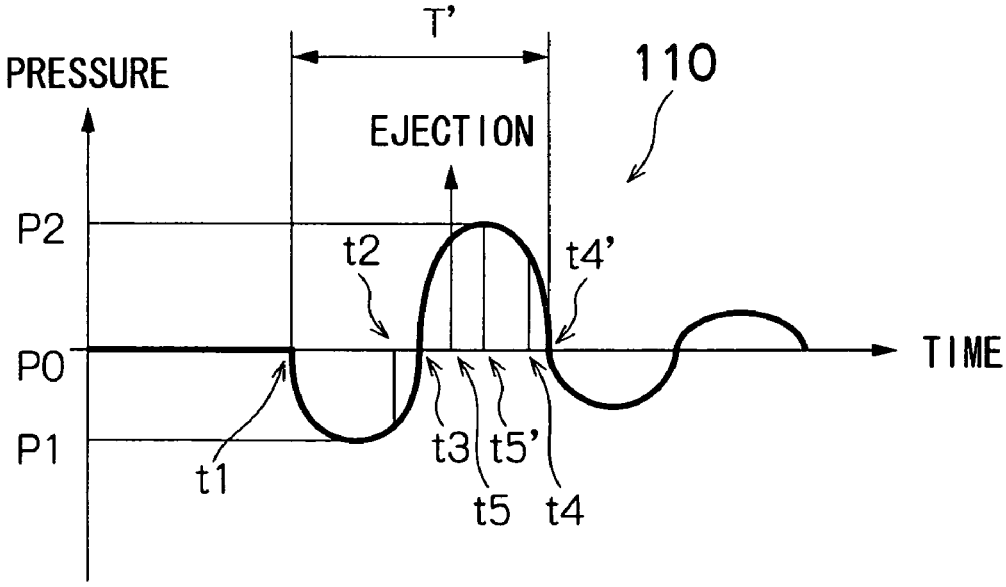

FIG. 8A shows the ejection drive signal 100 applied to a nozzle 51 that performs ejection for printing (image formation), of the nozzles 51 provided in a print head 50, and FIG. 8B shows the pressure waveform (pressure determination signal waveform) 110 of a pressure chamber 52 (namely, of the ink inside the pressure chamber 52) determined by the pressure determination device (which the actuator 58 also serves as in the present embodiment) provided in the pressure chamber 52, when the ejection drive signal 100 shown in FIG. 8A is applied.

In FIG. 8A, the horizontal axis shows time and the vertical axis shows voltage, and the voltage in the direction which causes the actuator 58 to operate so as to eject ink is taken to be the positive (upward) direction, while the voltage in the direction which causes the actuator 58 to operate so as to draw in the meniscus is taken to be the negative (downward) direction.

In general, in order to prevent ink leakage due to pressure fluctuation inside the print head 50 or the pressure chamber 52, the meniscus is stabilized by drawing in the meniscus surface slightly, toward the interior of the nozzle 51. Therefore, when the meniscus is in a stabilized state, a negative-direction voltage V0 is applied to the actuator 58.

More specifically, the ejection drive signal 100 shown in FIG. 8A is a pulse signal, which has an amplitude of voltage V1 in the negative direction and an amplitude of voltage V2 in the positive direction, with respect to a reference voltage formed by the applied voltage V0 for the stabilized meniscus state (stabilization voltage). FIG. 8A shows the ejection drive signal 100 for one cycle. However, it is also possible to take a state of no voltage application (namely, V0=0V) as the stabilized meniscus state, and to use this state of no voltage application as the reference voltage for the driving voltage (drive signal).

Between timing t1 and timing t2, the ejection drive signal 100 changes voltage in the negative direction, from the stabilization voltage V0 until the draw-in voltage V1, and after maintaining the draw-in voltage V1 for a prescribed period of time, the voltage changes from the draw-in voltage V1 to the stabilization voltage V0.

Furthermore, between timing t2 and timing t3, the stabilization voltage V0 is maintained, between timing t3 and timing t5, the voltage changes in the positive direction from the stabilization voltage V0 until the ejection voltage V2, and upon reaching the ejection voltage V2 at timing t5, the ejection voltage V2 is maintained for a prescribed period of time, whereupon the voltage changes from the ejection voltage V2 toward the stabilization voltage V0 and reaches the stabilization voltage V0 at timing t4.

In other words, the waveform of the ejection drive signal 100 is a waveform which combines a trapezoidal waveform in the negative direction (draw-in direction drive signal) 102 with a trapezoidal waveform in the positive direction (ejection direction drive signal) 104. The symbol T shown in FIG. 8A indicates the ejection cycle (the time period from timing t1 until timing t4), and in general, if this ejection cycle T (or ejection frequency 1/T) is set to the resonance cycle (resonance frequency) of the time constant of the pressure chamber 52 (the ink inside the pressure chamber 52), then ink can be ejected and refilled after ejection, with good efficiency.

Here, the maximum amplitudes V1 and V2 of the ejection drive signal 100 in the negative direction and positive direction may be the same voltage or they may be different voltages.

When the ejection drive signal 100 shown in FIG. 8A is applied to the actuator 58, the actuator 58 operates and applies a pressure to the pressure chamber 52. On the other hand, the actuator 58 can also function as a pressure determination device which outputs a voltage corresponding to the pressure in the pressure chamber 52, and thereby, a pressure waveform 110 such as that shown in FIG. 8B can be obtained.

In the pressure waveform 110, the direction of the pressure for ejecting ink is taken to be the positive (upward) direction and the direction of the pressure for drawing the meniscus into the nozzle 51 is taken to be the negative (downward) direction. Furthermore, the pressure waveform 110 is indicated with reference to the pressure P0 (stabilization pressure) when the meniscus is stabilized.

Between timing t1 and timing t2 when the draw-in direction drive signal 102 is applied, a meniscus draw-in operation is performed, and the pressure inside the pressure chamber 52 changes in the negative direction, from the stabilization pressure P0 until the draw-in pressure P1. Here, the change in the pressure of the pressure chamber 52 with respect to change in the ejection drive signal 100 is subject to a time delay, and the pressure does not reach the stabilization pressure P0 at timing t2, but rather, reaches the stabilization pressure P0 at timing t3, which is later than timing t2.

Then, between timing t3 and timing t4 during which time the ejection direction drive signal 104 is applied, the pressure in the pressure chamber 52 changes in the positive direction, from the stabilization pressure P0 until the ejection pressure P2, and ink is ejected at timing t5 where the ejection direction drive signal 104 reaches the ejection voltage V2.

Thereafter, at timing t5', which is later than timing t5, the pressure in the pressure chamber 52 reaches the ejection pressure P2; from timing t5', the pressure in the pressure chamber 52 decreases, and at timing t4' which is later than the timing t4 that comes after timing t5' and is the end of one cycle of the ejection direction drive signal, the pressure in the pressure chamber 52 reaches the stabilization pressure P0.

Here, the cycle T' of the pressure waveform 110 of the pressure chamber 52 is longer than the ejection cycle T by an amount corresponding to the time delay of the pressure chamber 52 (namely, of the ink inside the pressure chamber 52). The time delay of the pressure in the pressure chamber 52 with respect to the ejection drive signal 100 is caused by the time constant (resonance frequency) of the pressure chamber 52, the time constant of the ink, and the like.

As shown in FIG. 8B, from timing t4' onwards, due to the transient phenomenon of the pressure chamber 52 and the ink accommodated inside the pressure chamber 52, the pressure in the pressure chamber 52 converges to the stabilization pressure P0 after an attenuating oscillation of one or several cycles, rather than converging immediately to the stabilization pressure P0. The pressure waveform 110 shown in FIG. 8B converges to the stabilization pressure P0 after an attenuating oscillation of one cycle.

Figure 9A:
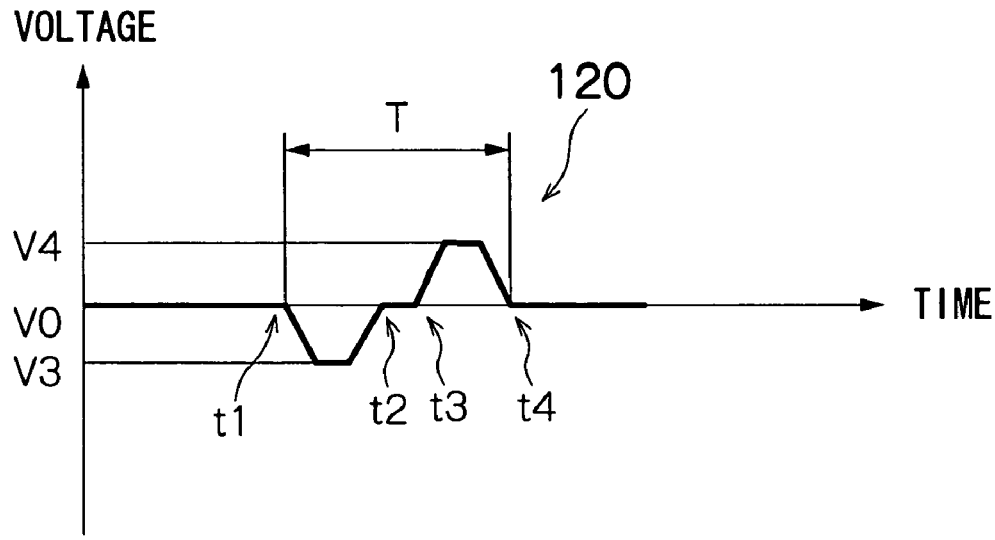
FIG.9A RELATED ART
FIGS. 9A and 9B are diagrams illustrating a meniscus vibration drive signal according to the related art.
Figure 9B:
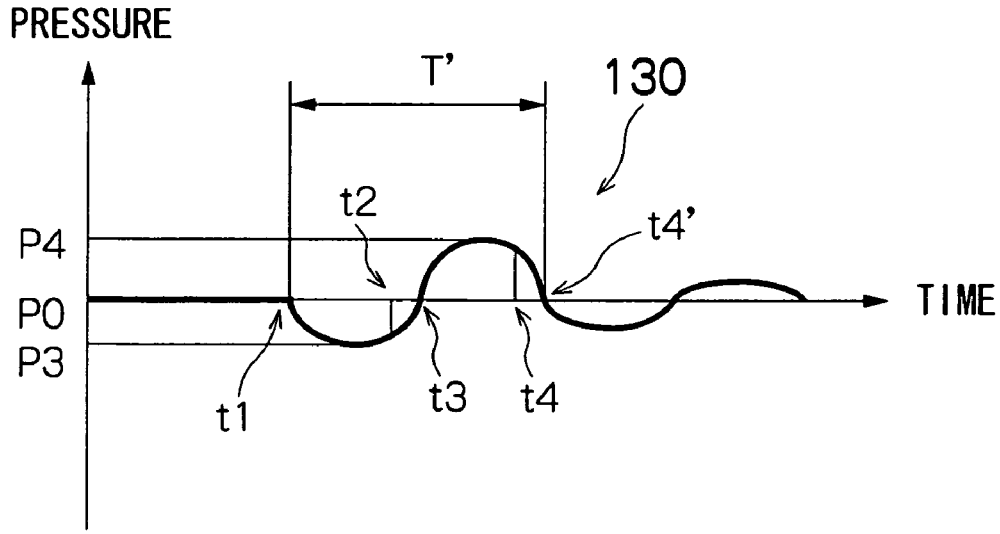
FIG.9B RELATED ART

FIG. 9A shows a meniscus vibration drive signal 120 according to the related art, and FIG. 9B shows a pressure waveform 130 of a pressure chamber 52 obtained when the meniscus vibration drive signal 120 shown in FIG. 9A is applied. In FIGS. 9A and 9B, items which are the same as or similar to those in FIGS. 8A and 8B are denoted with the same reference numerals and description thereof is omitted here.

As shown in FIG. 9A, the meniscus vibration drive signal 120 according to the related art has approximately the same cycle as the ejection cycle T, and forms a pulse signal having an amplitude of voltage V3 and voltage V4 in the negative direction and positive direction, respectively.

Between timing t1 and timing t2 during which period the meniscus is moved in the draw-in direction, the meniscus vibration drive signal 120 changes voltage in the negative direction from the stabilization voltage V0 to the voltage V3 (negative direction vibration drive voltage), and between timing t3 and timing t4 during which period the meniscus is moved in the ejection direction, the meniscus vibration drive signal 120 changes voltage in the positive direction from the stabilization voltage V0 to the voltage V4.

Here, the absolute value of the negative-direction vibration drive voltage V3 is smaller than the absolute value of the draw-in direction drive voltage V1 shown in FIG. 8A. Furthermore, the positive-direction vibration drive voltage V4 is smaller than the ejection voltage V2 illustrated in FIG. 8A. More specifically, the relationship between the voltages V1 to V4 is $|V3|<|V1|(V1<V3)$, and $V4<V2$.

When the meniscus vibration drive signal 120 shown in FIG. 9A is applied, then from timing t1, through timing t2, and to timing t3, the pressure waveform 130 changes from the stabilization pressure P0 in a negative direction until the negative-direction vibration pressure P3, and then changes from the negative-direction vibration pressure P3 until the stabilization pressure P0, virtually in synchronization with the meniscus vibration drive signal 120, as illustrated in FIG. 9B.

Furthermore, between timing t3 and timing t4, the pressure waveform 130 changes from the stabilization pressure P0 in the positive direction until the positive-direction vibration pressure P4, and then changes from the positive-direction vibration pressure P4 until the stabilization pressure P0. Similarly to the ejection drive waveform illustrated in FIGS. 8A and 8B, the cycle T' of the pressure waveform 130 is longer than the ejection cycle T by an amount corresponding to the time delay of the pressure change in the pressure chamber 52 (the ink inside the pressure chamber 52).

In this way, when the meniscus vibration drive signal 120 shown in FIG. 9A is applied, it is possible to cause the meniscus to vibrate in the draw-in direction and ejection direction, with respect to the stabilized state, and the pressure of the pressure chamber 52 changes from the negative-direction vibration pressure P3 to the positive-direction vibration pressure P4, with respect to the stabilization pressure P0, in accordance with this meniscus vibration.

The positive-direction vibration drive voltage V4 is set in such a manner that an ink droplet is not ejected from the nozzle 51 when the meniscus is moved in the ejection direction, and the positive-direction vibration pressure P4 is a pressure at which ink is not ejected from the nozzle 51.

Figure 10A:
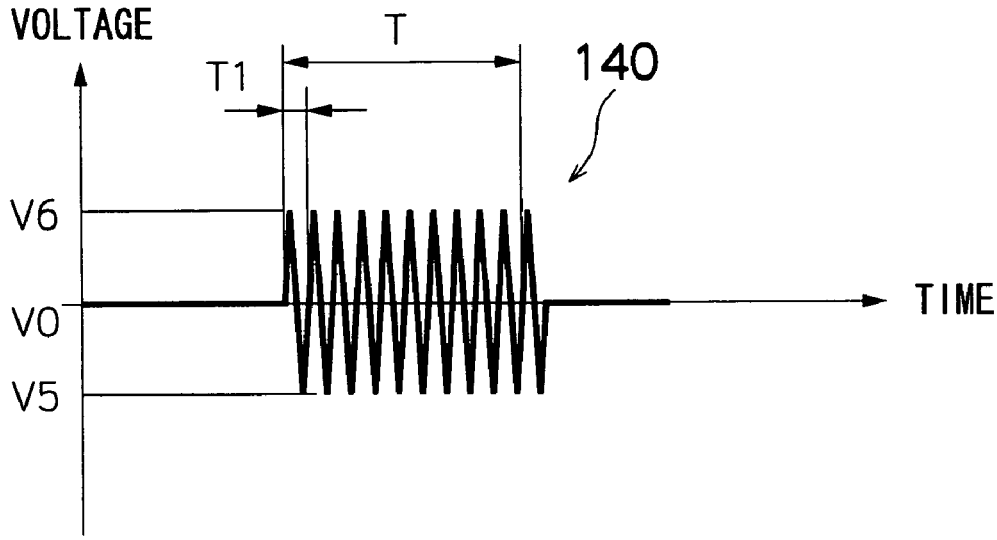
FIG.10A RELATED ART
FIGS. 10A and 10B are diagrams illustrating a further mode of the meniscus vibration drive signal illustrated in FIGS. 9A and 9B.

Here, an example is described in which the waveform of the meniscus vibration drive signal 120 shown in FIG. 9A is similar to the waveform of the ejection drive signal 100 shown in FIGS. 8A and 8B, but apart from this, it is also possible to use a pulse signal having a waveform that is not similar to the waveform of the ejection drive signal 100, and it is also possible to use a high-frequency pulse signal such as that illustrated in FIG. 10A. Furthermore, it is also possible to use a pulse signal having a rectangular waveform, rather than a trapezoidal waveform.

FIG. 10A shows a meniscus vibration drive signal 140 to which a high-frequency pulse signal according to the related art is applied. The meniscus vibration drive signal 140 shown in FIG. 10A has a cycle T1 which is sufficiently shorter than the ejection cycle T, and it has an amplitude of voltage V5 in the negative direction (draw-in direction), and an amplitude of voltage V6 in the positive direction (ejection direction), with respect to the stabilization voltage V0.

Figure 10B:
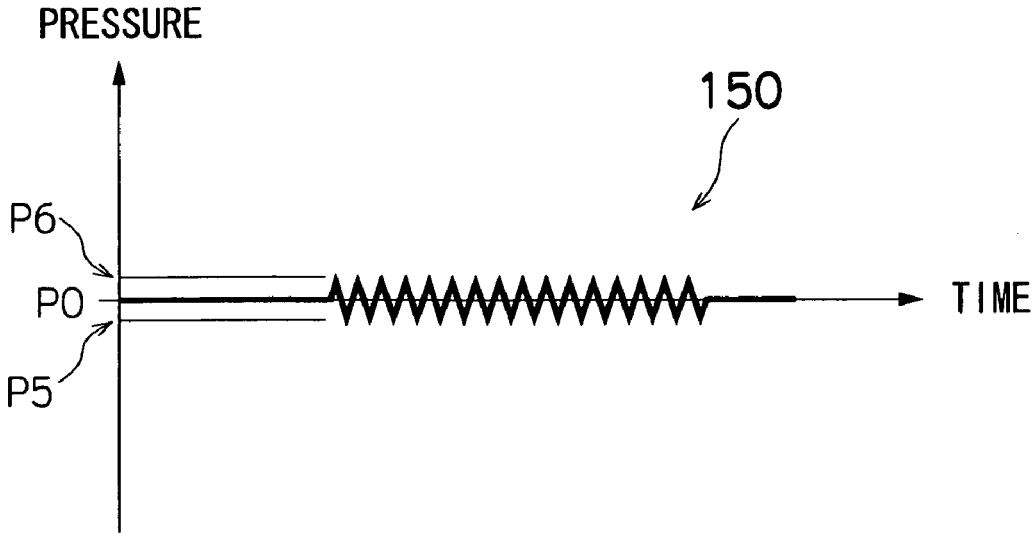
FIG.10B RELATED ART

Furthermore, FIG. 10B shows the pressure waveform 150 of the pressure chamber 52 when the meniscus vibration drive signal 140 shown in FIG. 10A is applied.

As shown in FIG. 10B, if a high-frequency pulse signal is used for the meniscus vibration drive signal 140, then since the maximum amplitude of the pressure waveform 150 is small, in accordance with the maximum amplitude of the meniscus vibration drive signal 140, it is possible to cause the meniscus to vibrate without ejecting ink from the nozzles 51.

More specifically, the change in the pressure in the pressure chamber 52 cannot follow the change in the voltage of the meniscus vibration drive signal 140, and since the voltage of the meniscus vibration drive signal 140 changes to the opposite direction to the direction of change of the pressure of the pressure chamber 52, before the pressure in the pressure chamber 52 reaches maximum pressure (maximum amplitude), then the pressure in the pressure chamber 52 cannot reach a pressure corresponding to the applied voltage. Due to this effect, when a high-frequency signal is used for the meniscus vibration drive signal 140, the changes of the draw-in direction pressure P5 and the ejection direction pressure P6 from the stabilization pressure P0 in the pressure chamber 52 are smaller than the changes of the pressure generated when voltages V5 and V6, respectively.

Here, in the meniscus vibration, it is possible to move the meniscus within a prescribed range inside the nozzle 51, and it is also possible to move the meniscus within a range which includes the exterior of the nozzle 51, in such a manner that no droplet breaks away from the liquid column inside the nozzle 51 even if the meniscus projects outside the nozzle 51.

Furthermore, in order to churn the ink inside the nozzles 51 effectively by means of vibrating the meniscus, the amount of movement of the meniscus (the amplitude of the meniscus vibration) should be large. Moreover, it is also possible to set the number of meniscus vibrations to a large number in order that the ink inside the nozzles 51 is churned effectively.

However, if a high-frequency pulse signal is used as a meniscus vibration drive signal, then a separate drive system to the ejection drive system is required, and moreover, the high-frequency pulse signal is difficult to design and it is difficult to generate the signal according to the design specifications. Furthermore, since the resonance frequency of the pressure chambers differs greatly from the frequency of the meniscus vibration drive signal, in practice, there is a large difference between the frequency of the meniscus vibration drive signal and the vibration frequency of the ink, and therefore, it is difficult to obtain the desired churning effect.

Next, a description is given of an abnormal state (pressure abnormality) in a pressure chamber 52 occurring when an air bubble has occurred inside a pressure chamber 52, or when the ink viscosity in the vicinity of the nozzle has risen, and the like.

Figure 11A:
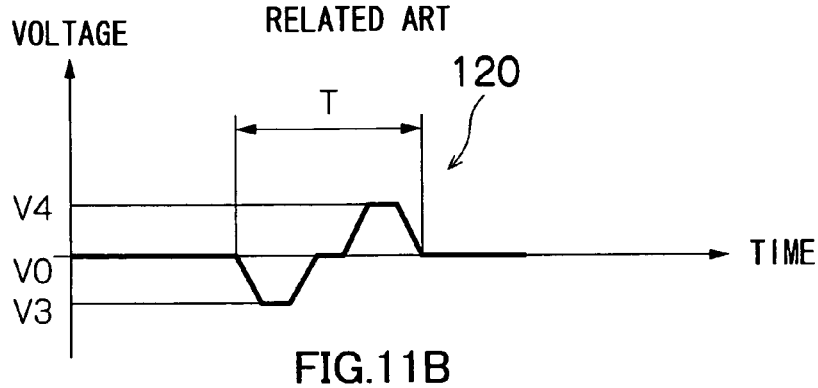
FIG.11A RELATED ART
FIGS. 11 A to 11D are diagrams illustrating pressure determination using the meniscus vibration drive signals illustrated in FIGS. 9A and 9B.
Figure 11B:
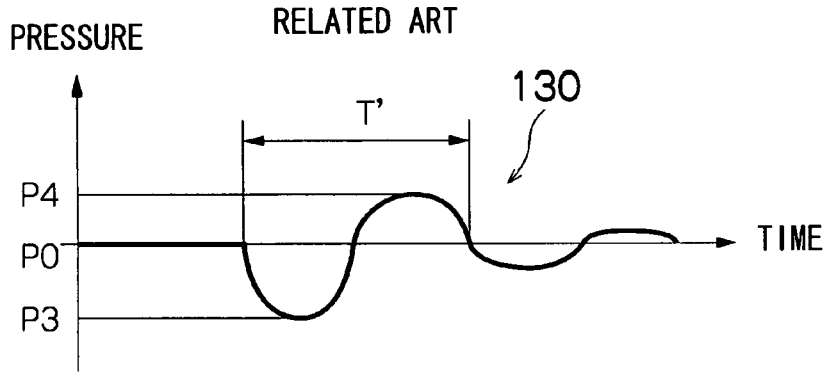
FIG.11B RELATED ART

FIG. 11A shows a meniscus vibration drive signal 120 according to the related art as illustrated in FIG. 9A, and FIG. 11B shows a pressure waveform 130 of the pressure chamber 52 during normal operation, as illustrated in FIG. 9B. Furthermore, FIGS. 11C and 11D show pressure waveforms 160 and 162 of pressure chambers 52 in abnormal states.

Figure 11C:
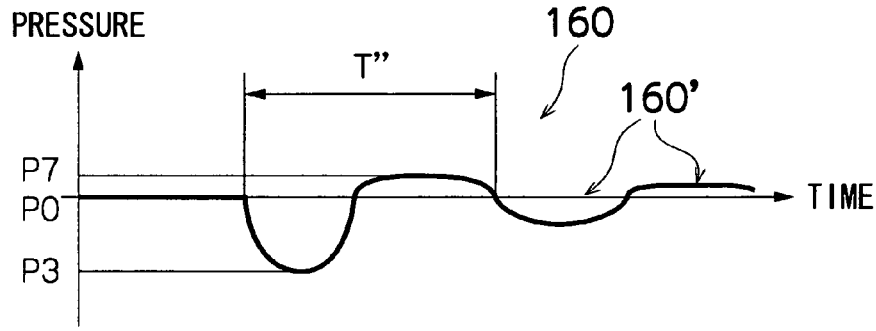
FIG.11C RELATED ART
Figure 11D:
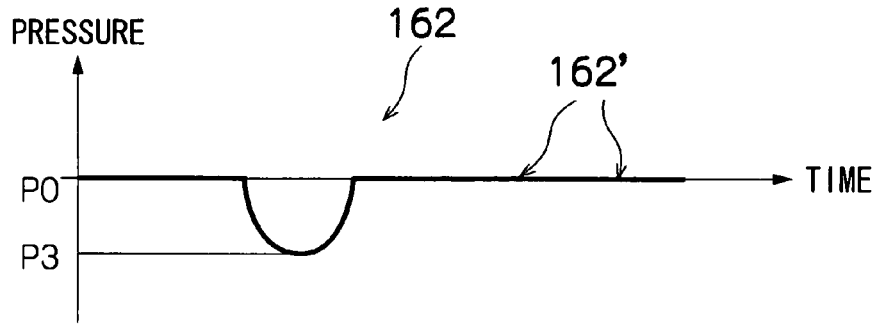
FIG.11D RELATED ART

The pressure waveform 160 of the pressure chamber 52 shown in FIG. 11C indicates the pressure change of the pressure chamber 52 in a case where an air bubble has occurred in the ink inside the pressure chamber 52. If an air bubble occurs in the ink inside the pressure chamber 52, then the resonance cycle of the pressure chamber 52 changes from T' to T", due to the presence of the air bubble, and furthermore, since a pressure loss occurs in the pressure chamber 52 in the ejection direction due to the air bubble generated in the ink inside the pressure chamber 52, then even if the prescribed pressure is applied to the ink inside the pressure chamber 52 by the actuator 58, the determined pressure of the pressure chamber 52 will be P7, which is lower than the prescribed pressure P4.

More specifically, in the state shown in FIG. 11C, even if a prescribed pressure is applied to the ink inside the pressure chamber 52 by the actuator 58, the effect of the pressure loss inside the pressure chamber 52 causes an ejection abnormality in the nozzle.

In the present example, a mode is shown in which there is no effect of pressure loss when drawing in the meniscus, but there are cases where there is also an effect of pressure loss when drawing in the meniscus, and where the meniscus cannot be drawn in by the prescribed amount.

The pressure waveform 162 of the pressure chamber 52 shown in FIG. 11D shows a case where the pressure loss is greater than the pressure waveform 160 shown in FIG. 11C (for example, a case where the quantity of air bubbles formed in the ink inside the pressure chamber 52 is greater than in FIG. 11C).

In the pressure waveform 162 of the pressure chamber 52 shown in FIG. 11D, the pressure in the ejection direction does not vary from the stabilization pressure P0. In this state, the pressure loss is virtually the same as the pressure in the ejection direction applied to the pressure chamber 52, and hence this is equivalent to a state in which no pressure is applied in the ejection direction.

In other words, in the state shown in FIG. 11D, since the pressure of the pressure chamber 52 in the ejection direction does not vary from P0, an ejection failure will occur and no ink will be ejected, even if a prescribed pressure is applied to the ink in the pressure chamber 52 by the actuator 58.

As described above, the pressure of the pressure chamber 52 is determined with respect to the meniscus vibration drive signals 120 and 140, and an ejection failure or ejection abnormality in a nozzle can be determined from the cycle, amplitude, and the like, of the corresponding pressure waveforms 130 and 150.

It is also possible to determine a pressure abnormality in the pressure chamber 52 from the pressure waveforms 160' and 162' after application of the meniscus vibration drive waveform 120.

However, in the case of the meniscus vibration drive signals 120 and 140 shown in FIGS. 9A and 10A, since the meniscus is moved in the ejection direction, there is a risk that an ink droplet may be ejected accidentally from the nozzle 51, due to temperature change, or fluctuation in the internal pressure of the head. Therefore, the meniscus vibration drive signals 120 and 140 must be designed to have a voltage of sufficiently small amplitude.

On the other hand, if the voltage amplitude of the meniscus vibration drive signals 120 and 140 is small, then the change in the pressure of the pressure chamber 52 is also small and the S/N ratio of the pressure determination signals 130 and 150 is reduced.

For this reason, it is not possible to obtain a desirable pressure waveform and hence it is difficult to determine the pressure in the pressure chamber 52. Moreover, the meniscus cannot be made to vibrate sufficiently, and it may occur that an insufficient effect in suppressing increase in the viscosity of the ink is obtained by vibrating the meniscus.

In this way, in meniscus vibration technology according to the related art, either a drive signal having a smaller amplitude than the ejection drive signal, or a high-frequency drive signal, has been used in order to cause the meniscus to vibrate without ejecting ink. On the other hand, in abnormality determination, desirably, the determination input signal (which corresponds to the meniscus vibration drive signal of the present example) has the largest possible amplitude, in order to raise the accuracy of the determination signal. It is very difficult to satisfy these various conditions simultaneously.

Furthermore, even if the prescribed pressure cannot be applied to the pressure chamber 52, due to a fault in the actuator 58, it is still possible to determine a pressure abnormality in the pressure chamber 52. Of course, a fault in the pressure determination device 98 can also be determined in a case where the actuator 58 is used as the pressure determination device, or a case where a pressure determination device 98 is provided separately to the actuator 58.

More specifically, it is possible to determine an abnormality in an ink chamber unit 53 from the pressure waveforms 130 and 150 of the pressure chamber 52, and if an abnormality occurs in the ink chamber unit 53, then it may not be possible to eject an ink droplet satisfactorily. Therefore, it is possible to determine an ejection abnormality from the pressure waveforms 130 and 150 of the pressure chamber 52.

Figure 12A:
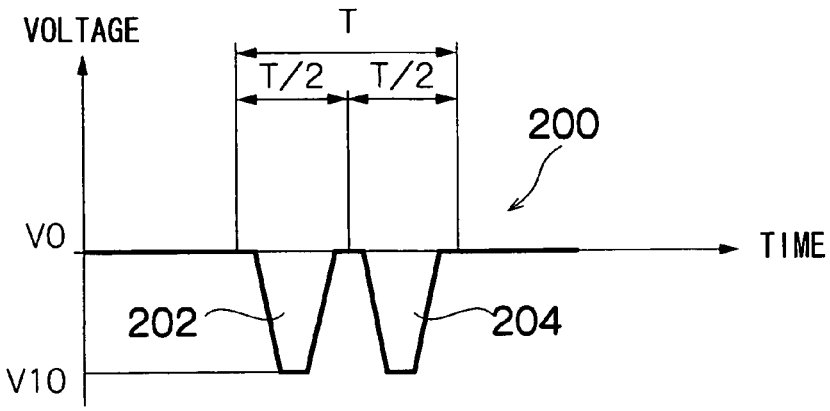
FIGS. 12A to 12D are diagrams illustrating a meniscus vibration drive signal and pressure determination according to an embodiment of the present invention.

In the present inkjet recording apparatus 10, a meniscus vibration drive signal 200 as shown in FIG. 12A is used instead of the meniscus vibration drive signals 120 and 140 according to the related art technology and illustrated in FIG. 9A and FIG. 10A.

FIG. 12A shows the meniscus vibration drive signal 200 according to an embodiment of the present invention. The meniscus vibration drive signal 200 comprises two continuous pulse signals 202 and 204 having negative-direction voltage V10 which causes the meniscus to move in the draw-in direction, and hence it has a W-shaped waveform in the negative direction.

Furthermore, the cycle of the pulse signal 202 and the pulse signal 204 is ½ of the ejection cycle (resonance cycle) T.

The maximum voltage V10 in the negative direction can have a relatively large absolute voltage value compared to the maximum voltage V3 in the negative direction of the meniscus vibration drive signal 120 shown in FIG. 9A or the maximum voltage V5 in the negative direction of the meniscus vibration drive signal 140 shown in FIG. 10A.

In other words, the meniscus vibration drive signal 200 is constituted by a drive pulse signal 202 in the meniscus draw-in direction, followed by a similar drive pulse signal 204 in the meniscus drawn-in direction, spaced at an interval equal to ½ of the ejection cycle (resonance cycle) T from the drive pulse signal 202. Therefore, the meniscus can be drive in the draw-in direction only.

In the present embodiment, it is supposed that the drive pulse signal 202 and the drive pulse signal 204 both have the same waveform, but waveforms of different amplitude and/or gradient may also be used.

Figure 12B:
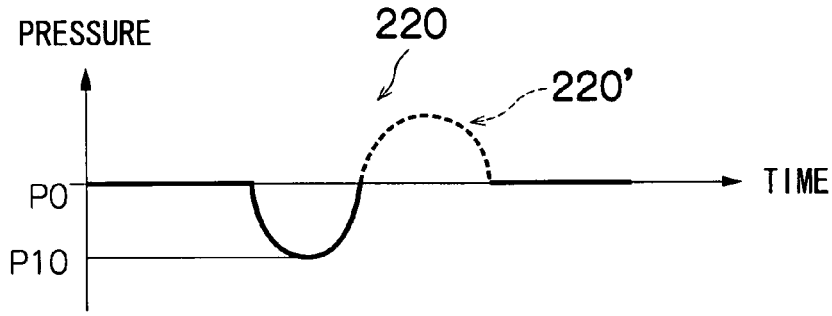
Figure 12C:
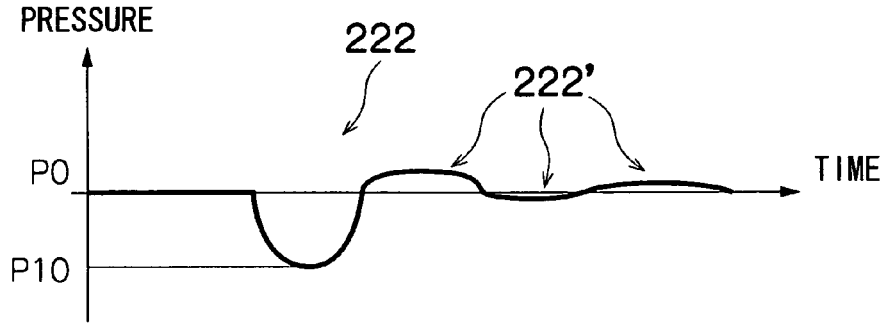
Figure 12D:
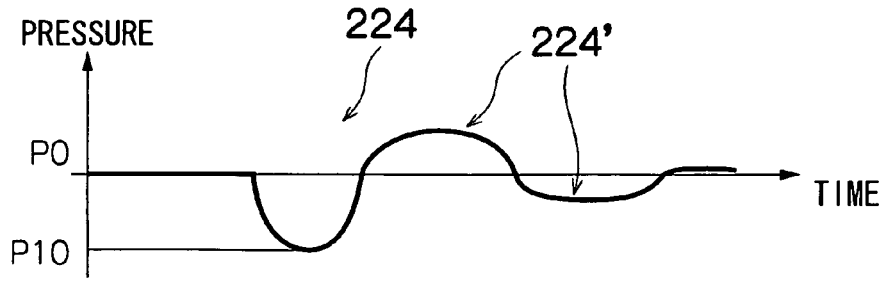

FIGS. 12B to 12D show the pressure waveforms 220, 222 and 224 of the pressure chamber 52 when the meniscus vibration drive signal 200 shown in FIG. 12A is applied.

The pressure waveform 220 shown in FIG. 12B indicates a pressure waveform during normal conditions. Firstly, when the meniscus is moved in the draw-in direction due to the pulse signal 202, the pressure changes in the negative direction from the stabilization pressure P0 until a pressure P10 corresponding to the voltage V10 (the maximum pressure in the draw-in direction), whereupon the pressure of the pressure chamber changes from the maximum pressure in the draw-in direction P10, to the stabilization pressure P0.

In this case, if the drive pulse signal 204 acting in the draw-in direction is then applied, then the meniscus which is seeking to move in the ejection direction due to a transient response (as shown with the broken line denoted with reference numeral 220') receives a pressure causing it to move in the draw-in direction, and hence the meniscus can be made to halt immediately at the stabilization position. The pressure of the pressure chamber 52 at this time is the stabilization pressure P0.

More specifically, since the meniscus vibration drive signal 200 is constituted by the drive pulse signal 202 in the meniscus draw-in direction, followed, at an interval of ½ of the ejection cycle, by the similar ejection pulse signal 204 in the draw-in direction, then oscillations in the pressure chamber 52 are suppressed effectively and ejection of an ink droplet from the nozzle 51 is prevented.

On the other hand, the pressure waveform 222 shown in FIG. 12C indicates a pressure waveform in an abnormal state, such as a state where air bubbles have occurred in the ink inside the pressure chamber 52.

In the abnormal state shown in FIG. 12C, frequently, there is change in the resonance cycle, and if the resonance cycle changes, then the oscillation suppressing effect is diminished and oscillations appear in the pressure waveform 222.

In other words, even if the drive pulse 204 acting in the draw-in direction is applied, the meniscus will not be halted at the stabilization position as shown in FIG. 12B, and residual oscillation 222' caused by a transient response will occur in the pressure waveform 222, as illustrated in FIG. 12C.

Furthermore, the pressure waveform 224 shown in FIG. 12D has a residual oscillation 224' of larger amplitude than the residual oscillation 222' of the pressure waveform 222 in the case of an abnormal state as illustrated in FIG. 12C. In this case, the oscillation suppressing effect is diminished yet further, and it can be seen that the pressure loss is greater (the abnormal state is more severe) than the abnormal state shown in FIG. 12C.

In this way, an abnormality in an ink chamber unit 53 is determined from a pressure determination signal obtained by determining the pressure in a pressure chamber 52, and hence the presence or absence of an ejection abnormality, and the state of the ejection abnormality, can be ascertained readily. Furthermore, the nozzles can be driven at an amplitude and cycle closer to those used when driving the nozzles to eject ink, and therefore, a greater churning effect can be obtained.

Here, a pressure abnormality in a pressure chamber 52 and the ink inside the pressure chamber 52 may arise in a case where air bubbles have occurred in the ink inside the pressure chamber 52 (where air bubbles or foreign matter has infiltrated into the pressure chamber 52), or a case where the viscosity of the ink in the vicinity of the meniscus has risen. Therefore, by determining a pressure abnormality in a pressure chamber 52, it is possible to discover an ejection failure or an ejection abnormality caused by the pressure abnormality.

In the present embodiment, the meniscus vibration drive signal 200 comprising two continuous waveforms is described, but it is also possible to compose the meniscus vibration drive signal 200 from n continuous waveforms (where $n \geqq 3$). Desirably, n is an even number.

Furthermore, the mode of applying the meniscus vibration drive signal 200 shown in FIG. 12A to an idle nozzle may involve applying the meniscus vibration drive signal 200 continuously at an interval of ½ of the ejection cycle, while the nozzle is idle, or it may involve applying the meniscus vibration drive signal 200 intermittently at prescribed intervals (for example, coinciding with a pressure determination timing, or the like).

The print head 50 may be divided into a plurality of blocks, in such a manner that the meniscus vibration drive signal 200 is applied to each block, in turn. Furthermore, the time period during which the meniscus vibration drive signal 200 is applied may be the same time period for each block, or it may vary in accordance with the number of nozzles (number of idle nozzles) contained in each of the blocks.

The meniscus vibration drive signal 200 should be applied at least once (namely, for one cycle) during the idle period.

Furthermore, it is also possible to determine the idle period of each nozzle, and to apply a meniscus vibration drive signal to those nozzles determined to have an idle time period which is longer than a previously established time period. The idle time period of each nozzle may be calculated (forecast) from the image data by an idle time period calculating device, or it may be found from the actual operating history by recording the operation history of each nozzle.

Next, an ejection abnormality determination device provided in the present inkjet recording apparatus 10 will be described.

Figure 13:
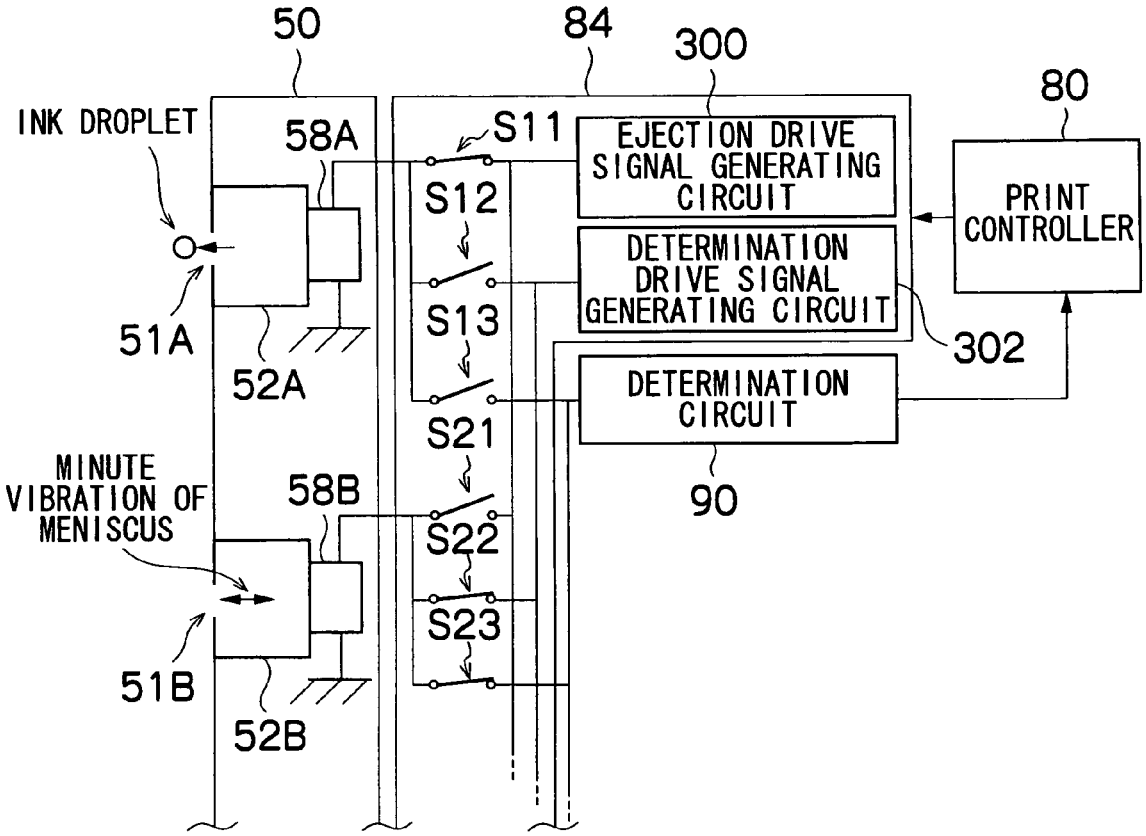
FIG. 13 is a block diagram showing the composition of an ejection abnormality determination device according to an embodiment of the present invention.

FIG. 13 is a block diagram showing the composition of an ejection abnormality determination device provided in the present inkjet recording apparatus 10.

As shown in FIG. 13, of the nozzles in the print head 50, a nozzle 51A that ejects ink accommodated in the pressure chamber 52A shown on the upper side in FIG. 13 is a nozzle that performs ejection when the print operation is performed, whereas a nozzle 51B that ejects ink accommodated in the pressure chamber 52B shown on the lower side in FIG. 13 is an idle nozzle that does not perform ejection when the print operation is performed.

The print controller 80 sends a command signal to the head driver 84 in such a manner that an ejection drive signal (for example, the ejection drive signal 100 shown in FIG. 8A) is applied to the actuator 58 (for example, an actuator 58A in FIG. 13) provided at the pressure chamber 52 (for example, the pressure chamber 52A in FIG. 13) having the nozzle 51 (for example, the nozzle 51A in FIG. 13) that performs ink ejection, whereas a determination drive signal (for example, the meniscus vibration drive signal 200 shown in FIG. 12A), which is a drive signal that does not cause ejection of ink, is applied to the actuator 58 (for example, the actuator 58B in FIG. 13) provided at the pressure chamber 52 (for example, the pressure chamber 52B in FIG. 13) having the nozzle 51 (for example, the nozzle 51B in FIG. 13) that does not perform ink ejection.

The head driver 84 is equipped with an ejection drive signal generating circuit 300 for generating an ejection drive signal, and a determination drive signal generating circuit 302 for generating a determination drive signal, and the head driver 84 is controlled in accordance with the command signal sent by the print controller 80, in such a manner that an ejection drive signal is applied to the nozzles that perform ejection, whereas a determination drive signal is applied to the idle nozzles, and pressure determination signals are sent from the corresponding actuators 58 to the determination circuit 90 in order to determine the pressure changes inside the pressure chambers 52 having the idle nozzles.

In other words, since the nozzle 51A performs ejection for printing, the switch S11 shown in FIG. 13 is turned on and an ejection drive signal is applied from the ejection drive signal generating circuit 300 to the actuator 58A provided at the pressure chamber 52A having the nozzle 51A.

Furthermore, the switch S12 is turned off in such a manner that a determination drive signal is not supplied to the actuator 58A. Since pressure determination of the pressure chamber 52A is not to be carried out in the nozzle 51A performing ejection, the switch S13, which connects the actuator 58A with the determination circuit 90, is also turned off.

On the other hand, in the case of the idle nozzle 51B, the switch S21 is turned off, the switch S22 is turned on, and hence a determination drive signal is supplied to the actuator 58B from the determination drive signal generating circuit 302, and furthermore, the switch S23 is turned on and a pressure determination signal is supplied from the actuator 58B to the determination circuit 90, where the pressure change in the pressure chamber 52B is determined.

The pressure determination signal is subjected to prescribed signal processing by the determination circuit 90, and is then sent to the print controller 80, which judges whether there is an ejection abnormality on the basis of the pressure determination signal (pressure waveform). If it judges that there is an ejection abnormality, then the print controller 80 implements a maintenance routine, such as purging, suctioning, or the like.

Here, PZT actuators are used for the actuators 58, which cause the corresponding pressure chambers to deform in accordance with drive signals, when drive signals are applied, and which also generate voltages in accordance with deformation (pressure changes) of the pressure chambers. Consequently, a displacement (distortion) corresponding to the pressure change in the pressure chamber 52 is produced in the actuator 58, and a voltage determination signal, which has a voltage that is directly proportional to the displacement (pressure change) of the pressure chamber (for example, the signal indicated by reference numeral 220, 222 or 224 in FIGS. 12B to 12D), is generated between the common electrode 55 and the individual electrode 57 shown in FIG. 4.

After applying the meniscus vibration drive signal 200 shown in FIG. 12A, the pressure determination signal is obtained from the individual electrode 57, the presence of an abnormality in the ink chamber unit 53 is judged by measuring the amplitude and cycle of the residual pressure waveform, and the occurrence of an ejection abnormality is determined on the basis of this judgment result.

In the present embodiment, a mode is described in which the pressure of the pressure chamber 52 is determined by measuring the voltage between the two electrodes while the piezoelectric element is driven (by means of the meniscus vibration drive signal 200), but it is also possible to measure the impedance of the piezoelectric element, or to measure the current (current waveform) during driving of the piezoelectric element, instead of measuring the voltage between the electrodes of the piezoelectric element. Naturally, it is also possible to measure the voltage, current and impedance in the piezoelectric element occurring during application of the meniscus vibration drive signal 200.

Furthermore, since the pressure inside the pressure chamber 52 is transmitted at a time delay from the timing at which the meniscus vibration drive signal 200 is applied, then the voltage, current and impedance at the electrodes of the piezoelectric element may also be measured after the meniscus vibration drive signal 200 has been applied (namely, after the end of the meniscus vibration drive signal 200).

Figure 14:
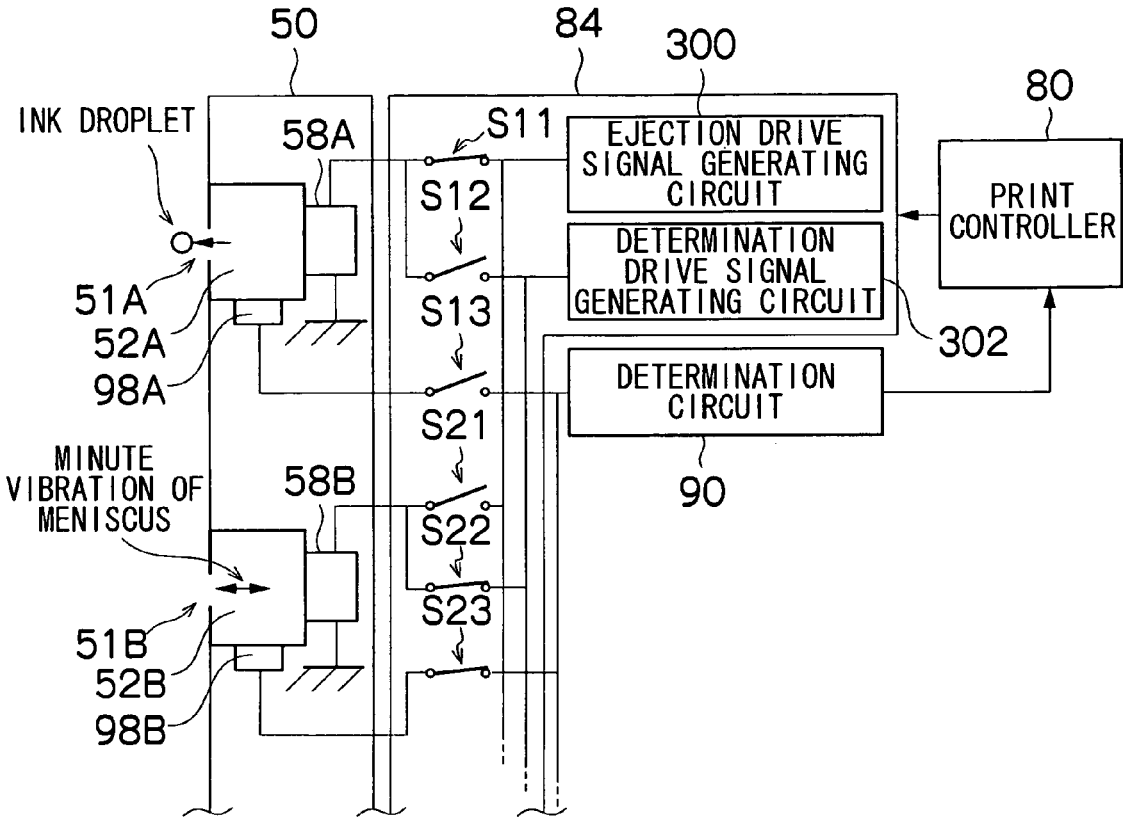
FIG. 14 is a block diagram showing a further mode of an ejection abnormality determination device illustrated in FIG. 13.

As shown in FIG. 14, it is also possible to provide the pressure determination device 98 shown in FIG. 7 (98A and 98B in FIG. 14), which determines pressure change in the pressure chamber 52, separately from the actuator 58. For the pressure determination device 98, it is possible to use an electrical distortion element (mechanical-electrical transducer), such as a piezoelectric element or distortion gauge (strain gauge), in which the displacement of a determination element is converted into a current or a voltage, in accordance with change in the pressure inside the pressure chamber 52.

By providing the pressure determination device 98 separately from the actuator 58, it is possible to use an electrical distortion element that has a high mechanical-electrical conversion rate for converting mechanical force into an electrical signal, for the pressure determination device. Furthermore, it is also possible to use an electrical distortion element that has a high electrical-mechanical conversion rate, for the actuator 58.

By means of a composition of this kind, it is possible to increase the efficiency and sensitivity of the determination of the pressure in the pressure chamber 52, while also maintaining ejection efficiency.

In the mode illustrated in FIG. 14, the switch S11 provided between the actuator 58A and the ejection drive signal generating circuit 300 is turned on in such a manner that an ejection drive voltage is applied to the actuator 58A provided at the pressure chamber 52A of the nozzle 51A that performs ejection for printing, and the switch S12 provided between the actuator 58A and the determination drive signal generating circuit 302, and the switch S13 provided between the pressure determination device 98A and the determination circuit 90 are turned off.

On the other hand, in the case of the idle nozzle 51B (pressure chamber 52B), the switch S21 provided between the actuator 58B and the ejection drive signal generating circuit 300 is turned off, whereas the switch S22 provided between the actuator 58B and the determination drive signal generating circuit 302, and the switch S23 provided between the pressure determination device 98B and the determination circuit 90 are turned on.

FIGS. 13 and 14 show the modes where the drive signal applied to the nozzles performing ejection and the idle nozzles is switched by means of the switching device including the switch S11 to the switch S23 provided in the head driver 84, but the switching device may also be provided externally to the head driver 84.

Furthermore, rather than using the switching device, it is also possible to have a common signal output section for the ejection drive signal generating circuit 300 and the determination drive signal generating circuit 302, and to switch the types of the drive signals to be outputted by means of software, or an enable signal, for instance.

On the other hand, it is also possible to omit the switching device (for example, the switches S13 and S23 in FIGS. 13 and 14) between the determination circuit 90 and the actuator 58 or the pressure determination device 98, and to send a pressure determination signal from the actuator 58 or the pressure determination device 98 to the determination circuit 90 at all times, control being implemented in such a manner that the pressure determination signal is sent from the determination circuit 90 to the print controller 80 in accordance with the timing at which pressure determination is performed.

The timing for determining the pressure of the pressure chambers corresponding to idle nozzles may be such that the pressure of the pressure chambers is determined constantly while the determination drive signal is inputted, or such that pressure of the pressure chambers is determined at prescribed time intervals (in synchronism with a prescribed sampling signal). Furthermore, it is also possible to determine the pressure of the pressure chambers at a particular timing, such as the timing at which the determination drive signal inputted.

More specifically, it is also possible to provide a plurality of sampling signals (for example, a sampling signal for performing constant sampling, and a sampling signal for performing sampling as prescribed timings), and to provide a sampling signal selection device to select between these sampling signals. In some embodiments, the print controller 80 may fulfill the role of a sampling signal selection device.

In the inkjet recording apparatus 10 having the composition described above, a meniscus vibration drive signal 200 is applied to an idle nozzle, which does not perform ejection for printing, thereby suppressing increase in the viscosity of the ink in the vicinity of the meniscus, as well as determining pressure change inside the pressure chamber 52 corresponding to the idle nozzle, and an abnormality in the corresponding ink chamber unit 53 caused, for instance, by the occurrence of air bubbles inside the pressure chamber 52, is determined from the pressure waveform (pressure information) for the pressure chamber 52. Furthermore, since it is possible to determine an ejection abnormality from an abnormality in the ink chamber unit 53, abnormality determination can be performed in respect of idle nozzles simultaneously with a printing operation (in other words, during actual printing), and therefore, even if the abnormality determination operation takes time, it does not produce any dead time in which printing is not possible. Moreover, even in a print head having a large number of nozzles, it is still possible to prevent reduction in the printing capacity.

Furthermore, since abnormalities are determined in respect of nozzles that do not perform ejection (in other words, nozzles having a high probability of suffering an ejection abnormality), then the efficiency of abnormality determination is increased in cases where there is a large number of nozzles.

On the other hand, since the meniscus vibration drive signal 200 is constituted by a pulse signal 202 in the meniscus draw-in direction, followed, at an interval of ½ of the resonance cycle during ejection, by a similar pulse signal 204 in the meniscus draw-in direction, oscillations in the pressure chamber 52 are effectively suppressed, and ejection of an ink droplet from a nozzle 51 during application of the meniscus vibration drive signal 200 is prevented.

In the above-described embodiments, a print head used in an inkjet recording apparatus is described as an example of a liquid droplet ejection head, but the present invention may also be applied to an ejection head used in a liquid ejection apparatus which forms images, or shapes, such as circuit wiring or machining patterns, by ejecting a liquid (such as water, a chemical solution, resist, or processing liquid) onto an ejection receiving medium, such as a wafer, glass substrate, epoxy substrate, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

an ejection head which has a plurality of ejection elements, each of the ejection elements from amongst the plurality of ejection elements including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber;

a meniscus vibration drive signal application device which applies to the pressurizing device a meniscus vibration drive signal for suppressing increase in viscosity of the liquid in vicinity of the ejection aperture by causing a meniscus surface of the liquid to vibrate and to eject no droplet from the ejection aperture;

a pressure determination device which determines pressure in the pressure chamber when the meniscus surface is vibrated by the meniscus vibration drive signal; and an ejection abnormality judgment device which judges an abnormal state of the ejection element from pressure information of the pressure chamber based on pressure determination information obtained by the pressure determination device wherein the pressure determination device is configured to determine pressure in the pressure chamber when the ejection element is in an idle state during an ejection operation where other ejection elements are ejecting ink during said ejection operation.

2. The liquid ejection apparatus as defined in claim 1, further comprising a sampling cycle selection device which selects a sampling cycle at which the pressure of the pressure chamber is determined by the pressure determination device.

3. The liquid ejection apparatus as defined in claim 1, wherein the meniscus vibration drive signal comprises at least two continuous signals which drive the pressurizing device in such a manner that the meniscus surface is drawn in, in a direction opposite to a liquid ejection direction.

4. The liquid ejection apparatus as defined in claim 3, wherein voltage waveforms of the at least two continuous signals are the same.

5. The liquid ejection apparatus as defined in claim 1, wherein:

the pressure determination device comprises a mechanical-electrical transducer which is provided separately from the pressurizing device and generates a signal in accordance with pressure applied to the mechanical-electrical transducer; and the pressure determination device determines the pressure of the pressure chamber through the mechanical-electrical transducer.

6. The liquid ejection apparatus of claim 5, further comprising:

a first wire through which the meniscus vibration drive signal is applied to the pressurizing device; and a second wire though which the signal generated by the mechanical-electrical transducer is transmitted, the second wire being separate from the first wire.

7. The liquid ejection apparatus as defined in claim 1, wherein the pressurizing device also serves as the pressure determination device.

8. The liquid ejection apparatus as defined in claim 7, wherein the pressure determination device comprises a mechanical-electrical transducer which generates a signal in accordance with displacement thereof, and determines the pressure of the pressure chamber by measuring at least one of impedance, voltage and current of the mechanical-electrical transducer.

9. The liquid ejection apparatus of claim 7, further comprising a common wire though which the meniscus vibration drive signal is applied to the pressurizing device and though which a pressure determination signal is transmitted from the pressure determination device.

10. An ejection abnormality determination method for a liquid ejection apparatus comprising an ejection head which has at least one ejection element, the ejection element including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber, the method comprising the steps of:

applying to the pressurizing device a meniscus vibration drive signal for suppressing increase in viscosity of the liquid in vicinity of the ejection aperture by causing a meniscus surface of the liquid to vibrate and to eject no droplet from the ejection aperture;

determining a pressure abnormality in the pressure chamber; and judging an ejection abnormality in the ejection aperture provided at the pressure chamber from a result obtained in the pressure abnormality determining step said determining a pressure abnormality comprising determining a pressure abnormality in the pressure chamber when the ejection element is in an idle state during an ejection operation where other ejection elements are ejecting ink during said ejection operation.

11. Ejection abnormality determination method as defined in claim 10, further comprising selecting a sampling cycle at which the pressure of the pressure chamber is determined.

12. The ejection abnormality determination method as defined in claim 10, wherein applying to the pressurizing device a meniscus vibration drive signal comprises applying at least two continuous signals to drive the pressurizing device in such a manner that the meniscus surface is drawn in, in a direction opposite to a liquid ejection direction.

13. The ejection abnormality determination method as defined in claim 12, wherein voltage waveforms of the at least two continuous signals are the same.

14. A liquid ejection apparatus, comprising:

an ejection head which has an ejection element, the ejection element including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber;

a meniscus vibration drive signal application device which applies to the pressurizing device a meniscus vibration drive signal for suppressing increase in viscosity of the liquid in vicinity of the ejection aperture by causing a meniscus surface of the liquid to vibrate and to eject no droplet from the ejection aperture;

a pressure determination device which determines pressure in the pressure chamber when the meniscus surface is vibrated by the meniscus vibration drive signal; and an ejection abnormality judgment device which judges an abnormal state of the ejection element from pressure information of the pressure chamber based on pressure determination information obtained by the pressure determination device, wherein the meniscus vibration drive signal comprises at least two continuous signals which drive the pressurizing device in such a manner that the meniscus surface is drawn in, in a direction opposite to a liquid ejection direction, the two continuous signals including:

a first signal which drives the pressurizing device in such a manner that the meniscus surface is drawn in, in the direction opposite to the liquid ejection direction; and a second signal which is continuous to the first signal and drives the pressurizing device in such a manner that the meniscus surface is drawn in, in the direction opposite to the liquid ejection direction, wherein taking a resonance cycle of liquid ejection to be T, a time difference between a start point of the first signal and a start point of the second signal is T/2.

15. A liquid ejection apparatus, comprising:

an ejection head which has a plurality of ejection elements, each of the plurality of ejection elements including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber;

a meniscus vibration drive signal application device which applies, to the pressurizing device of at least one of the plurality of ejection elements having an idle ejection aperture performing no ejection during an ejection operation, a meniscus vibration drive signal for suppressing increase in viscosity of the liquid in vicinity of the idle ejection aperture by causing a meniscus surface of the liquid to vibrate and to eject no droplet from the idle ejection aperture during an ejection operation;

a pressure determination device which determines pressure in the pressure chamber of the at least one of the plurality of ejection elements having an idle ejection aperture when the meniscus surface is vibrated by the meniscus vibration drive signal during said ejection operation; and an ejection abnormality judgment device which judges an abnormal state of the at least one of the plurality of ejection elements having an idle ejection aperture from pressure information of the pressure chamber based on pressure determination information obtained by the pressure determination device during said ejection operation, where the ejection head is configured such that at least one of said plurality of ejection elements is ejecting ink during said ejection operation.

16. An ejection abnormality determination method for a liquid ejection apparatus comprising an ejection head which has an ejection element, the ejection element including an ejection aperture through which a droplet of liquid is ejected onto an ejection receiving medium, a pressure chamber which is connected to the ejection aperture and accommodates the liquid to be ejected from the ejection aperture, and a pressurizing device which applies an ejection pressure to the liquid accommodated in the pressure chamber, the method comprising the steps of:

applying to the pressurizing device a meniscus vibration drive signal for suppressing increase in viscosity of the liquid in vicinity of the ejection aperture by causing a meniscus surface of the liquid to vibrate and to eject no droplet from the ejection aperture;

determining a pressure abnormality in the pressure chamber; and judging an ejection abnormality in the ejection aperture provided at the pressure chamber from a result obtained in the pressure abnormality determining step, wherein applying to the pressurizing device a meniscus vibration drive signal comprises applying at least two continuous signals to drive the pressurizing device in such a manner that the meniscus surface is drawn in, in a direction opposite to a liquid ejection direction, wherein applying at least two continuous signals includes:

applying a first signal to drive the pressurizing device in such a manner that the meniscus surface is drawn in, in the direction opposite to the liquid ejection direction; and applying a second signal which is continuous to the first signal to drive the pressurizing device in such a manner that the meniscus surface is drawn in, in the direction opposite to the liquid ejection direction, wherein taking a resonance cycle of liquid ejection to be T, a time difference between a start point of the first signal and a start point of the second signal is T/2.

* * * * *